US011608720B2

(12) United States Patent
Preiss et al.

(10) Patent No.: US 11,608,720 B2
(45) Date of Patent: Mar. 21, 2023

(54) PERFORATING GUN SYSTEM WITH ELECTRICAL CONNECTION ASSEMBLIES

(71) Applicant: DynaEnergetics Europe GmbH, Troisdorf (DE)

(72) Inventors: Frank Haron Preiss, Bonn (DE); Liam McNelis, Bonn (DE); Eric Mulhern, Edmonton (CA); Thilo Scharf, Letterkenny (IE); David C. Parks, Calgary (CA); Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 16/809,729

(22) Filed: Mar. 5, 2020

(65) Prior Publication Data

US 2020/0199983 A1 Jun. 25, 2020

Related U.S. Application Data

(60) Continuation of application No. 16/585,790, filed on Sep. 27, 2019, now Pat. No. 10,844,697, which is a (Continued)

(30) Foreign Application Priority Data

Jul. 18, 2013 (CA) ..... CA 2821506

(51) Int. Cl.
*E21B 43/1185* (2006.01)
*F42D 1/02* (2006.01)
(Continued)

(52) U.S. Cl.
CPC ..... *E21B 43/1185* (2013.01); *E21B 43/119* (2013.01); *E21B 43/11855* (2013.01); (Continued)

(58) Field of Classification Search
CPC ... F42C 19/06; F42D 1/02; F42D 1/04; F42D 1/043; E21B 43/1185; E21B 43/11855; E21B 43/119
See application file for complete search history.

(56) References Cited

U.S. PATENT DOCUMENTS 2,216,359 A 10/1940 Spencer
2,228,873 A 1/1941 Hardt et al.
(Continued)

FOREIGN PATENT DOCUMENTS

CA 288787 A 4/1929
CA 2003166 A1 5/1991
(Continued)

OTHER PUBLICATIONS

United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
(Continued)

*Primary Examiner* — Joshua T Semick
(74) *Attorney, Agent, or Firm* — Moyles IP, LLC

(57) ABSTRACT

Components for a perforation gun system are provided including combinations of components that facilitate electrically linking multiple perforation guns to one another with wireless electrical contacts. The perforation gun system includes a bulkhead pin contact assembly. The perforation gun system may further include a wireless detonator and a conductor positioned in a connector of the perforation gun.

19 Claims, 18 Drawing Sheets

Related U.S. Application Data continuation of application No. 16/359,540, filed on Mar. 20, 2019, now Pat. No. 10,472,938, which is a continuation of application No. 15/920,812, filed on Mar. 14, 2018, which is a continuation of application No. 15/617,344, filed on Jun. 8, 2017, now Pat. No. 10,429,161, which is a division of application No. 15/287,309, filed on Oct. 6, 2016, now Pat. No. 9,702,680, which is a division of application No. 14/904,788, filed as application No. PCT/CA2014/050673 on Jul. 16, 2014, now Pat. No. 9,494,021.

(51) Int. Cl.
*F42D 1/04* (2006.01)
*E21B 43/119* (2006.01)
*F42C 19/06* (2006.01)

(52) U.S. Cl.
CPC ..... *F42C 19/06* (2013.01); *F42D 1/02* (2013.01); *F42D 1/04* (2013.01); *F42D 1/043* (2013.01)

(56) References Cited

U.S. PATENT DOCUMENTS 2,326,406 A 8/1943 Lloyd
2,358,466 A 9/1944 Miller
2,418,486 A 4/1947 Smylie
2,543,814 A 3/1951 Thompson et al.
2,598,651 A 5/1952 Spencer
2,655,993 A 10/1953 Lloyd
2,734,456 A 2/1956 Sweetman
2,742,857 A 4/1956 Turechek
2,755,863 A 7/1956 Stansbury et al.
2,785,631 A 3/1957 Blanchard
2,821,136 A 1/1958 Castel
2,889,775 A 6/1959 Owen
2,906,339 A 9/1959 Griffin
2,946,283 A 7/1960 Udry
2,982,210 A 5/1961 Andrew et al.
3,040,659 A 6/1962 Mcculleugh
RE25,407 E 6/1963 Lebourg
3,125,024 A 3/1964 Hicks et al.
3,158,680 A 11/1964 Lovitt et al.
3,170,400 A 2/1965 Nelson
3,173,992 A * 3/1965 Boop ..... H01B 17/306 174/151
RE25,846 E 8/1965 Campbell
3,208,378 A 9/1965 Boop
3,246,707 A 4/1966 Bell
3,264,989 A 8/1966 Rucker
3,264,994 A 8/1966 Kurt
3,374,735 A 3/1968 Moore
3,504,723 A 4/1970 Cushman et al.
3,565,188 A 2/1971 Hakala
3,859,921 A 1/1975 Stephenson
4,007,790 A 2/1977 Henning
4,007,796 A * 2/1977 Boop ..... E21B 43/1185 175/4.55
4,039,239 A 8/1977 Cobaugh et al.
4,058,061 A 11/1977 Mansur, Jr. et al.
4,107,453 A 8/1978 Erixon
4,132,171 A 1/1979 Pawlak et al.
4,140,188 A 2/1979 Vann
4,172,421 A 10/1979 Regalbuto
4,182,216 A 1/1980 DeCaro
4,191,265 A 3/1980 Bosse-Platiere
4,208,966 A 6/1980 Hart
4,220,087 A 9/1980 Posson
4,266,613 A * 5/1981 Boop ..... F42D 1/04 166/299
4,290,486 A 9/1981 Regalbuto
4,312,273 A 1/1982 Camp
4,363,529 A 12/1982 Loose
4,485,741 A 12/1984 Moore et al.
4,491,185 A 1/1985 McClure
4,496,008 A 1/1985 Pottier et al.
4,512,418 A 4/1985 Regalbuto et al.
4,523,649 A 6/1985 Stout
4,523,650 A 6/1985 Sehnert et al.
4,534,423 A 8/1985 Regalbuto
4,574,892 A 3/1986 Grigar et al.
4,598,775 A 7/1986 Vann et al.
4,609,057 A 9/1986 Walker et al.
4,621,396 A 11/1986 Walker et al.
4,643,097 A 2/1987 Chawla et al.
4,650,009 A 3/1987 McClure et al.
4,655,138 A 4/1987 Regalbuto et al.
4,657,089 A 4/1987 Stout
4,660,910 A 4/1987 Sharp et al.
4,730,793 A 3/1988 Thurber, Jr. et al.
4,744,424 A 5/1988 Lendermon et al.
4,747,201 A 5/1988 Donovan et al.
4,753,170 A 6/1988 Regallbuto et al.
4,762,067 A 8/1988 Barker et al.
4,776,393 A 10/1988 Forehand et al.
4,790,383 A 12/1988 Savage et al.
4,796,708 A 1/1989 Lembcke
4,800,815 A 1/1989 Appledorn et al.
4,852,494 A * 8/1989 Williams ..... E21B 43/1185 102/263
4,869,171 A 9/1989 Abouav
4,889,183 A 12/1989 Sommers et al.
4,919,050 A 4/1990 Dobrinski et al.
5,006,833 A 4/1991 Marlowe et al.
5,027,708 A 7/1991 Gonzalez
5,038,682 A 8/1991 Marsden
5,052,489 A 10/1991 Carisella et al.
5,060,573 A 10/1991 Montgomery et al.
5,088,413 A 2/1992 Huber
5,105,742 A 4/1992 Sumner
5,159,145 A 10/1992 Carisella et al.
5,159,146 A 10/1992 Carisella et al.
5,204,491 A 4/1993 Aureal et al.
5,322,019 A 6/1994 Hyland
5,323,684 A 6/1994 Umphries
5,347,929 A 9/1994 Lerche et al.
5,358,418 A 10/1994 Carmichael
5,392,851 A 2/1995 Arend
5,392,860 A 2/1995 Ross
5,436,791 A 7/1995 Turano et al.
5,503,077 A 4/1996 Motley
5,564,499 A 10/1996 Willis et al.
5,603,384 A 2/1997 Bethel et al.
5,648,635 A 7/1997 Lussier et al.
5,671,899 A 9/1997 Nicholas et al.
5,673,760 A 10/1997 Brooks et al.
5,703,319 A 12/1997 Fritz et al.
5,756,926 A 5/1998 Bonbrake et al.
5,775,426 A 7/1998 Snider et al.
5,785,130 A 7/1998 Wesson et al.
5,803,175 A 9/1998 Myers, Jr. et al.
5,816,343 A 10/1998 Markel et al.
5,820,402 A 10/1998 Chiacchio et al.
5,837,925 A 11/1998 Nice
5,911,277 A 6/1999 Hromas et al.
5,992,289 A 11/1999 George et al.
6,006,833 A 12/1999 Burleson et al.
6,012,525 A 1/2000 Burleson et al.
6,056,058 A 5/2000 Gonzalez
6,070,662 A 6/2000 Ciglenec et al.
6,085,659 A 7/2000 Beukes et al.
6,112,666 A 9/2000 Murray et al.
6,263,283 B1 7/2001 Snider et al.
6,269,875 B1 8/2001 Harrison, III et al.
6,298,915 B1 10/2001 George
6,305,287 B1 10/2001 Capers et al.
6,333,699 B1 12/2001 Zierolf
6,354,374 B1 3/2002 Edwards et al.
6,378,438 B1 4/2002 Lussier et al.
6,385,031 B1 5/2002 Lerche et al.
6,386,108 B1 5/2002 Brooks et al.
6,408,758 B1 6/2002 Duguet

(56) References Cited

U.S. PATENT DOCUMENTS 6,412,388 B1 7/2002 Frazier
6,412,415 B1 7/2002 Kothari et al.
6,418,853 B1 7/2002 Duguet et al.
6,419,044 B1 7/2002 Tite et al.
6,439,121 B1 8/2002 Gillingham
6,467,415 B2 10/2002 Menzel et al.
6,474,931 B1 11/2002 Austin et al.
6,487,973 B1 12/2002 Gilbert, Jr. et al.
6,497,285 B2 12/2002 Walker
6,506,083 B1 1/2003 Bickford et al.
6,582,251 B1 6/2003 Burke et al.
6,618,237 B2 9/2003 Eddy et al.
6,651,747 B2 11/2003 Chen et al.
6,659,180 B2 12/2003 Moss
6,675,896 B2 1/2004 George
6,702,009 B1 3/2004 Drury et al.
6,719,061 B2 4/2004 Muller et al.
6,739,265 B1 5/2004 Badger et al.
6,742,602 B2 6/2004 Trotechaud
6,752,083 B1 6/2004 Lerche et al.
6,773,312 B2 8/2004 Bauer et al.
6,779,605 B2 8/2004 Jackson
6,837,310 B2 1/2005 Martin
6,843,317 B2 1/2005 Mackenzie
6,851,471 B2 2/2005 Barlow et al.
6,851,476 B2 2/2005 Gray et al.
7,013,977 B2 3/2006 Nordaas
7,044,230 B2 5/2006 Starr et al.
7,093,664 B2 8/2006 Todd et al.
7,107,908 B2 9/2006 Forman et al.
7,168,494 B2 1/2007 Starr et al.
7,182,625 B2 2/2007 Machado et al.
7,193,527 B2 3/2007 Hall
7,226,303 B2 6/2007 Shaikh
7,234,521 B2 6/2007 Shammai et al.
7,237,626 B2 7/2007 Gurjar et al.
7,243,722 B2 7/2007 Oosterling et al.
7,278,491 B2 10/2007 Scott
7,306,038 B2 12/2007 Challacombe
7,347,278 B2 3/2008 Lerche et al.
7,347,279 B2 3/2008 Li et al.
7,350,448 B2 4/2008 Bell et al.
7,353,879 B2 4/2008 Todd et al.
7,357,083 B2 4/2008 Takahara et al.
7,364,451 B2 * 4/2008 Ring ..... H01R 13/521 439/271
7,387,162 B2 6/2008 Mooney, Jr. et al.
7,441,601 B2 10/2008 George et al.
7,455,104 B2 11/2008 Duhon et al.
7,493,945 B2 2/2009 Doane et al.
7,510,017 B2 * 3/2009 Howell ..... E21B 17/028 166/118
7,540,758 B2 6/2009 Ho
7,568,429 B2 8/2009 Hummel et al.
7,591,212 B2 9/2009 Myers, Jr. et al.
7,647,978 B2 1/2010 Scott
7,726,396 B2 6/2010 Briquet et al.
7,735,578 B2 6/2010 Loehr et al.
7,752,971 B2 7/2010 Loehr
7,762,172 B2 7/2010 Li et al.
7,762,331 B2 * 7/2010 Goodman ..... E21B 43/117 166/299
7,762,351 B2 7/2010 Vidal
7,775,279 B2 8/2010 Marya et al.
7,778,006 B2 8/2010 Stewart et al.
7,810,430 B2 10/2010 Chan et al.
7,901,247 B2 3/2011 Ring
7,908,970 B1 3/2011 Jakaboski et al.
7,929,270 B2 4/2011 Hummel et al.
7,934,453 B2 5/2011 Moore
7,980,874 B2 7/2011 Finke et al.
8,028,624 B2 10/2011 Mattson
8,066,083 B2 11/2011 Hales et al.
8,069,789 B2 12/2011 Hummel et al.
8,074,737 B2 12/2011 Hill et al.
8,079,296 B2 12/2011 Barton et al.
8,091,477 B2 1/2012 Brooks et al.
8,127,846 B2 3/2012 Hill et al.
8,136,439 B2 3/2012 Bell
8,141,434 B2 3/2012 Kippersund et al.
8,151,882 B2 4/2012 Grigar et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,256,337 B2 9/2012 Hill
8,336,437 B2 12/2012 Barlow et al.
8,336,635 B2 12/2012 Greenlee et al.
8,388,374 B2 3/2013 Grek et al.
8,395,878 B2 3/2013 Stewart et al.
8,413,727 B2 4/2013 Holmes
8,451,137 B2 5/2013 Bonavides et al.
8,468,944 B2 6/2013 Givens et al.
8,596,378 B2 12/2013 Mason et al.
8,661,978 B2 3/2014 Backhus et al.
8,678,666 B2 3/2014 Scadden et al.
8,684,083 B2 4/2014 Torres et al.
8,695,506 B2 4/2014 Lanclos
8,807,003 B2 8/2014 Le et al.
8,807,206 B2 8/2014 Walker
8,833,441 B2 9/2014 Fielder et al.
8,863,665 B2 10/2014 DeVries et al.
8,869,887 B2 * 10/2014 Deere ..... E21B 33/0385 166/242.6
8,875,787 B2 11/2014 Tassaroli
8,881,816 B2 11/2014 Glenn et al.
8,884,778 B2 11/2014 Lerche et al.
8,943,943 B2 2/2015 Tassaroli
8,960,093 B2 2/2015 Preiss et al.
8,960,288 B2 2/2015 Sampson
9,065,201 B2 6/2015 Borgfeld et al.
9,080,433 B2 7/2015 Lanclos et al.
9,145,763 B1 9/2015 Sites, Jr.
9,145,764 B2 * 9/2015 Burton ..... H02G 9/00
9,181,790 B2 11/2015 Mace et al.
9,194,219 B1 11/2015 Hardesty et al.
9,206,675 B2 12/2015 Hales et al.
9,284,819 B2 3/2016 Tolman et al.
9,284,824 B2 3/2016 Fadul et al.
9,297,242 B2 3/2016 Zhang et al.
9,317,038 B2 4/2016 Ozick et al.
9,347,755 B2 5/2016 Backhus et al.
9,359,863 B2 6/2016 Streich et al.
9,383,237 B2 7/2016 Wiklund et al.
9,476,289 B2 10/2016 Wells
9,494,021 B2 11/2016 Parks et al.
9,523,271 B2 12/2016 Bonavides et al.
9,581,422 B2 2/2017 Preiss et al.
9,593,548 B2 3/2017 Hill et al.
9,598,942 B2 3/2017 Wells et al.
9,605,937 B2 3/2017 Eitschberger et al.
9,677,363 B2 * 6/2017 Schacherer ..... E21B 29/02
9,689,223 B2 6/2017 Schacherer et al.
9,702,211 B2 7/2017 Tinnen
9,709,373 B2 7/2017 Hikone et al.
9,784,549 B2 10/2017 Eitschberger
9,903,192 B2 2/2018 Entchev et al.
10,066,921 B2 9/2018 Eitschberger
10,077,626 B2 9/2018 Xu et al.
10,077,641 B2 * 9/2018 Rogman ..... E21B 43/11855
10,138,713 B2 11/2018 Tolman et al.
10,151,180 B2 12/2018 Robey et al.
10,188,990 B2 1/2019 Burmeister et al.
10,190,398 B2 1/2019 Goodman et al.
10,267,611 B2 4/2019 Lownds et al.
10,352,136 B2 7/2019 Goyeneche
10,352,144 B2 7/2019 Entchev et al.
10,422,195 B2 9/2019 LaGrange et al.
10,458,213 B1 10/2019 Eitschberger et al.
D873,373 S 1/2020 Hartman et al.
D892,278 S 3/2020 Eitschberger
10,900,335 B2 1/2021 Knight et al.
2002/0020320 A1 2/2002 Lebaudy et al.
2002/0062991 A1 5/2002 Farrant et al.

(56) References Cited

U.S. PATENT DOCUMENTS

2003/0000411 A1 1/2003 Cernocky et al.
2003/0001753 A1 1/2003 Cernocky et al.
2004/0141279 A1 7/2004 Amano et al.
2004/0211862 A1 10/2004 Elam
2004/0216633 A1 11/2004 Kash
2005/0115441 A1 6/2005 Mauldin
2005/0139352 A1 6/2005 Mauldin
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0202720 A1 9/2005 Burke et al.
2005/0218260 A1 10/2005 Corder et al.
2005/0229805 A1 10/2005 Myers, Jr. et al.
2005/0257710 A1 11/2005 Monetti et al.
2006/0189208 A1 8/2006 Shaikh
2007/0084336 A1 4/2007 Neves
2007/0125540 A1 6/2007 Gerez et al.
2007/0158071 A1 7/2007 Mooney et al.
2008/0047456 A1 2/2008 Li et al.
2008/0047716 A1 2/2008 McKee et al.
2008/0073081 A1 3/2008 Frazier et al.
2008/0110612 A1 5/2008 Prinz et al.
2008/0110632 A1 5/2008 Beall
2008/0134922 A1 6/2008 Grattan et al.
2008/0149338 A1 6/2008 Goodman et al.
2008/0173204 A1 7/2008 Anderson et al.
2008/0173240 A1 7/2008 Furukawahara et al.
2008/0264639 A1 10/2008 Parrott et al.
2008/0314591 A1 12/2008 Hales et al.
2009/0050322 A1 2/2009 Hill et al.
2009/0159285 A1 6/2009 Goodman
2009/0272519 A1 11/2009 Green et al.
2009/0272529 A1 11/2009 Crawford
2009/0301723 A1 12/2009 Gray
2009/0308589 A1 12/2009 Bruins et al.
2010/0000789 A1 1/2010 Barton et al.
2010/0012774 A1 1/2010 Fanucci et al.
2010/0024674 A1 2/2010 Peeters et al.
2010/0065302 A1 3/2010 Nesbitt
2010/0089643 A1 4/2010 Vidal
2010/0096131 A1 4/2010 Hill et al.
2010/0107917 A1 5/2010 Moser
2010/0132946 A1 6/2010 Bell et al.
2010/0163224 A1 7/2010 Strickland
2010/0230104 A1 9/2010 Nölke et al.
2010/0252323 A1 10/2010 Goodman et al.
2010/0286800 A1 11/2010 Lerche et al.
2010/0300750 A1 12/2010 Hales et al.
2011/0024116 A1 2/2011 McCann et al.
2011/0042069 A1 2/2011 Bailey et al.
2011/0056362 A1 3/2011 Yang et al.
2011/0301784 A1 12/2011 Oakley et al.
2012/0006217 A1 1/2012 Anderson
2012/0085538 A1 4/2012 Guerrero et al.
2012/0094553 A1 4/2012 Fujiwara et al.
2012/0160483 A1 6/2012 Carisella
2012/0199031 A1 8/2012 Lanclos
2012/0199352 A1 8/2012 Lanclos et al.
2012/0241169 A1 9/2012 Hales et al.
2012/0242135 A1 9/2012 Thomson et al.
2012/0247769 A1 10/2012 Schacherer et al.
2012/0247771 A1* 10/2012 Black ..... E21B 43/1185 166/297
2012/0298361 A1 11/2012 Sampson
2013/0008639 A1 1/2013 Tassaroli
2013/0008669 A1 1/2013 Deere et al.
2013/0043074 A1 2/2013 Tassaroli
2013/0062055 A1 3/2013 Tolman et al.
2013/0118342 A1 5/2013 Tassaroli
2013/0168083 A1 7/2013 McCarter et al.
2013/0199843 A1 8/2013 Ross
2013/0248174 A1 9/2013 Dale et al.
2013/0256464 A1 10/2013 Belik et al.
2014/0033939 A1 2/2014 Priess et al.
2014/0053750 A1 2/2014 Lownds et al.
2014/0131035 A1 5/2014 Entchev et al.
2015/0176386 A1 6/2015 Castillo et al.
2015/0226044 A1 8/2015 Ursi et al.
2015/0330192 A1 11/2015 Rogman et al.
2016/0040520 A1 2/2016 Tolman et al.
2016/0061572 A1 3/2016 Eitschberger et al.
2016/0069163 A1 3/2016 Tolman et al.
2016/0084048 A1* 3/2016 Harrigan ..... E21B 43/117 175/4.57
2016/0160568 A1 6/2016 Randall
2016/0168961 A1 6/2016 Parks et al.
2016/0202033 A1 7/2016 Shahinpour et al.
2016/0273902 A1 9/2016 Eitschberger
2016/0356132 A1 12/2016 Burmeister et al.
2017/0030693 A1 2/2017 Preiss et al.
2017/0145798 A1 5/2017 Robey et al.
2017/0211363 A1 7/2017 Bradley et al.
2017/0241244 A1 8/2017 Barker et al.
2017/0268860 A1 9/2017 Eitschberger
2017/0276465 A1 9/2017 Parks et al.
2017/0298716 A1 10/2017 McConnell et al.
2017/0314372 A1 11/2017 Tolman et al.
2018/0030334 A1 2/2018 Collier et al.
2018/0119529 A1 5/2018 Goyeneche
2018/0135398 A1 5/2018 Entchev et al.
2018/0202789 A1 7/2018 Parks et al.
2018/0209251 A1 7/2018 Robey et al.
2018/0274342 A1 9/2018 Sites
2018/0299239 A1 10/2018 Eitschberger et al.
2018/0306010 A1 10/2018 Von Kaenel et al.
2018/0318770 A1 11/2018 Eitschberger et al.
2019/0040722 A1 2/2019 Yang et al.
2019/0048693 A1 2/2019 Henke et al.
2019/0049225 A1 2/2019 Eitschberger
2019/0085685 A1 3/2019 McBride
2019/0162056 A1 5/2019 Sansing
2019/0195054 A1 6/2019 Bradley et al.
2019/0211655 A1 7/2019 Bradley et al.
2019/0234188 A1 8/2019 Goyeneche
2019/0284889 A1 9/2019 Lagrange et al.
2019/0292887 A1 9/2019 Austin, II et al.
2019/0316449 A1 10/2019 Schultz et al.
2019/0338612 A1 11/2019 Holodnak et al.
2020/0063537 A1 2/2020 Langford et al.
2020/0072029 A1 3/2020 Anthony et al.
2020/0088011 A1 3/2020 Eitschberger et al.
2020/0199983 A1 6/2020 Preiss et al.
2020/0217635 A1 7/2020 Eitschberger
2020/0248535 A1 8/2020 Goyeneche
2020/0256168 A1 8/2020 Knight et al.
2020/0284104 A1 9/2020 Holmberg et al.

FOREIGN PATENT DOCUMENTS

CA 2821506 A1 1/2015
CA 2824838 A1 2/2015
CN 85107897 A 9/1986
CN 2661919 12/2004
CN 2821154 9/2006
CN 101397890 A 4/2009
CN 101454635 A 6/2009
CN 101691837 B 4/2010
CN 101178005 B 10/2010
CN 201620848 U 11/2010
CN 201764910 U 3/2011
CN 102878877 A 1/2013
CN 103993861 A 8/2014
DE 102007007498 10/2015
EP 0088516 A1 9/1983
EP 132330 B1 9/1988
EP 0216527 B1 11/1990
EP 0416915 A2 3/1991
EP 0180520 B1 5/1991
EP 679859 A2 11/1995
EP 0482969 B1 8/1996
EP 694157 B1 8/2001
EP 1473437 A2 11/2004
EP 2702349 B1 11/2015

(56) References Cited

FOREIGN PATENT DOCUMENTS

| | | | |
|---|---|---|---|
| EP | 2310616 | B1 | 10/2017 |
| GB | 2383236 | B | 1/2004 |
| GB | 2404291 | A | 1/2005 |
| JP | 2003329399 | A | 11/2003 |
| RU | 2295694 | C2 | 3/2007 |
| RU | 93521 | U1 | 4/2010 |
| RU | 100552 | U1 | 12/2010 |
| RU | 2434122 | C2 | 11/2011 |
| RU | 2561828 | C2 | 9/2015 |
| RU | 2633904 | C1 | 10/2017 |
| WO | 1988002056 | A1 | 3/1988 |
| WO | 1999005390 | A1 | 2/1999 |
| WO | 0133029 | A2 | 5/2001 |
| WO | 2001059401 | A1 | 8/2001 |
| WO | 2001096807 | A2 | 12/2001 |
| WO | 2009091422 | A2 | 7/2009 |
| WO | 2009142957 | A1 | 11/2009 |
| WO | 2009091422 | A3 | 3/2010 |
| WO | 2011160099 | A1 | 12/2011 |
| WO | 2012006357 | A2 | 1/2012 |
| WO | 2012135101 | A2 | 10/2012 |
| WO | 2012106640 | A3 | 11/2012 |
| WO | 2012149584 | A1 | 11/2012 |
| WO | 2014046670 | A1 | 3/2014 |
| WO | 2015006869 | A1 | 1/2015 |
| WO | 2015134719 | A1 | 9/2015 |
| WO | 2015134719 | A8 | 9/2015 |
| WO | 2016100269 | A1 | 6/2016 |
| WO | 2018009223 | A1 | 1/2018 |
| WO | 2019148009 | A2 | 8/2019 |

OTHER PUBLICATIONS

United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
IPR2018-00600, Exhibit 3001, Patent Owner's Precedential Opinion Panel Request Letter in regard to Case IPR2018-00600 for U.S. Pat. No. 9,581,422 B2, dated Sep. 18, 2019, 2 pg.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Opposition to Patent Owners Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of U.S. Pat. No. 9,581,422, dated Mar. 7, 2019, 44 pgs.
United States Patent and Trademark Office, Case IPR2018-00600 for U.S. Pat. No. 9,581,422 B2, Reply in Support of Patent Owner's Motion to Amend, dated Mar. 21, 2019, 15 pgs.
United States Patent and Trademark Office, Final Office Action of U.S. Appl. No. 16/540,484, dated Mar. 30, 2020, which is in the same family as U.S. Appl. No. 16/809,729, 12 pgs.
United States Patent and Trademark Office, Non-final Office Action of U.S. Appl. No. 16/455,816, dated Nov. 5, 2019, 17 pgs.
United States Patent and Trademark Office, Non-final Office Action of U.S. Appl. No. 16/451,440, dated Oct. 24, 2019, 22 pgs.
United States Patent and Trademark Office, Non-final Office Action of U.S. Appl. No. 16/542,890, dated Nov. 4, 2019, 16 pgs.
Austin Powder Company, A-140 F & Block, Detonator & Block Assembly, 2 pgs.
Owen Oil Tools & Pacific Scientific; Side Block for Side Initiation, 1 pg.
SIPO, Office Action dated Jun. 27, 2018: See Office Action for CN App. No. 201580011132.7, which is in the same family as PCT App. No. PCT/US2015/18906, 9 pgs. & 5 pgs.
Amit Govil, Selective Perforation: A Game Changer in Perforating Technology—Case Study, presented at the 2012 European and West African Perforating Symposium, Schlumberger, Nov. 7-9, 2012, 14 pgs.
DynaEnergetics, DYNAselect System, information downloaded from website, Jul. 3, 2013, 2 pgs., http://www.dynaenergetics.com/.
GB Intellectual Property Office, Search Report for App. No. GB 1700625.5, which is in the same family as U.S. Pat. No. 9,494,021, dated Jul. 7, 2017, 5 pgs.
International Search Report and Written Opinion of International Application No. PCT/US2015/018906, dated Jul. 10, 2015, 12 pgs.
DynaEnergetics, Gun Assembly, Products Summary Sheet, May 7, 2004, 1 pg.
GB Intellectual Property Office, Office Action dated Feb. 27, 2018, See Office Action for App. No. GB 1717516.7, which is the same family as PCT App. No. PCT/CA2014/050673, 6 pg.
DynaEnergetics, Selective Perforating Switch, information downloaded from website, Jul. 3, 2013, 2 pgs.,http://www.dynaenergetics.com/.
Hunting Titan, Wireline Top Fire Detonator Systems, Product Information Sheet, 1 pg.
Hunting Titan Inc., Petition for Inter Parties Review of U.S. Pat. No. 9,581,422, filed Feb. 16, 2018, 93 pgs.
DynaEnergetics GMBH & Co. KG, Patent Owner's Response to Hunting Titan's Petition for Inter Parties Review, Filed Dec. 6, 2018, 73 pgs.
DynaEnergetics GMBH & Co. KG, Patent Owner's Motion to Amend, filed Dec. 6, 2018, 53 pgs.
U.S. Patent Trial and Appeal Board, Institution of Inter Partes Review, Case IPR2018-00600, issued on Aug. 21, 2018, 9 pgs.
International Written Opinion of International Application No. PCT/CA2014/050673, dated Oct. 9, 2014, 4 pgs.
International Search Report of International Application No. PCT/CA2014/050673, dated Oct. 9, 2014, 3 pgs.
UK Examination Report of United Kingdom Patent Application No. GB1600085.3, which is in the same family as U.S. Pat. No. 9,494,021, dated Mar. 9, 2016, 1 pg.
Fiip, Search Report dated Feb. 1, 2018, in Russian: See Search Report for RU App. No. 2016104882/03, which is in the same family as PCT App. No. PCT/CA2014/050673, 7 pgs.
Fiip, Search Report dated Feb. 1, 2018, in English See Search Report for RU App. No. 2016104882/03, which is in the same family as PCT App. No. PCT/CA2014/050673, 4 pages.
Norwegan Industrial Property Office, Office Action for NO Patent App. No. 20160017, which is in the same family as PCT App No. PCT/CA2014/050673, dated Jun. 15, 2017, 3 pgs.
Jet Research Center Inc., Red RF Safe Detonators Brochure, 2008, 2 pgs., www.jetresearch.com.
Jet Research Center Inc., JRC Catalog, 36 pgs., www.jetresearch.com.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.

(56) References Cited

OTHER PUBLICATIONS

Smylie, New Safe and Secure Detonators for the Industry's consideration, Presented at Explosives Safety & Security Conference Marathon Oil Co, Houston, Feb. 23-24, 2005, 20 pages.
Schlumberger, Combining and Customizing Technologies for Perforating Horizontal Wells in Algeria, Presented at 2011 MENAPS Middle East and North Africa Perforating Symposium, Nov. 28-30, 2011, 20 pages.
Baker Hughes, Long Gun Deployment Systems IPS-12-28, Presented at 2012 International Perforating Symposium, Apr. 26-28, 2011, 11 pages.
Owen Oil Tools, Recommended Practice for Oilfield Explosive Safety, Presented at 2011 MENAPS Middle East and North Africa Perforating Symposium, Nov. 28-30, 2011, 6 pages.
Norwegan Industrial Property Office, Search Report for NO Patent App. No. 20160017, which is in the same family as PCT App No. PCT/CA2014/050673, dated Jun. 15, 2017, 2 pgs.
Intellectual Property India, Office Action of IN Application No. 201647004496, dated Jun. 7, 2019, which is in the same family as PCT App No. PCT/CA2014/050673, 6 pgs.
United States Patent and Trademark Office, Office Action of U.S. Appl. No. 15/920,812, dated Dec. 27, 2019, 6 pgs.
United States Patent and Trademark Office, Office Action of U.S. Appl. No. 15/920,812, dated May 27, 2020, 5 pgs.
United States Patent and Trademark Office, Office Action of U.S. Appl. No. 16/026,431, dated Jul. 30, 2019, 10 pgs.
United States Patent and Trademark Office, Office Action of U.S. Appl. No. 16/359,540, dated Aug. 14, 2019, 9 pgs.
United States Patent and Trademark Office, Office Action of U.S. Appl. No. 16/359,540, dated May 3, 2019, 11 pgs.
United States Patent and Trademark Office, Office Action of U.S. Appl. No. 16/540,484, dated Oct. 4, 2019, 12 pgs.
United States Patent and Trademark Office, Office Action of U.S. Appl. No. 16/585,790, dated Nov. 12, 2019, 9 pgs.
United States Patent and Trademark Office, Office Action of U.S. Appl. No. 29/733,080, dated Jun. 26, 2020, 8 pgs.
United States Patent and Trademark Office; Notice of Allowance for U.S. Appl. No. 16/387,696; dated Jan. 29, 2020; 7 pages.
USPTO; Notice of Allowance for U.S. Appl. No. 14/904,788; dated Jul. 6, 2016; 8 pages.
USPTO; Supplemental Notice of Allowability for U.S. Appl. No. 14/904,788; dated Jul. 21, 2016; 3 pages.
Corelab, RF-Safe Green Detonator, Data Sheet, Jul. 26, 2017, 2 pages.
DynaEnergetics Europe; Complaint and Demand for Jury Trial, Civil Action No. 6:20-cv-00069; dated Jan. 30, 2020; 9 pages.
DynaEnergetics Europe; Complaint and Demand for Jury Trial,Civil Action No. 4:17-cv-03784; dated Dec. 14, 2017; 7 pages.
DynaEnergetics Europe; Exhibit B Invalidity Claim Chart for Civil Action No. 4:19-cv-01611; dated May 2, 2019; 52 pages.
DynaEnergetics Europe; Plaintiffs' Local Patent Rule 3-1 Infringement Contentions for Civil Action No. 4:19-cv-01611; dated May 25, 2018; 10 Pages.
DynaEnergetics Europe; Plaintiffs' Motion to Dismiss Defendants' Counterclaim and to strike Affirmative Defenses, Civil Action No. 4:17-cv-03784; dated Feb. 20, 2018; 9 pages.
DynaEnergetics Europe; Plaintiffs' Preliminary Claim Constructions and Identification of Extrinsic Evidence Civil Action No. 4:17-cv-03784; dated Aug. 3, 2018; 9 pages.
DynaEnergetics Europe; Plaintiffs' Preliminary Infringement Contentions, Civil Action No. 6:20-cv-00069-ADA; dated Apr. 22, 2020; 32 pages.
DynaEnergetics Europe; Plaintiffs' Reply in Support of Motion to Dismiss and Strike for Civil Action No. 6:20-cv-00069-ADA; dated Apr. 29, 2020; 15 pages.
DynaEnergetics Europe; Plaintiffs Response to Defendant Hunting Titan Ins' Inoperative First Amended Answer, Affirmative Defenses, and Counterclaims for Civil Action No. 6:20-cv-00069-ADA; dated May 13, 2020.
DynaEnergetics Europe; Plaintiffs' Response to Defendants' Answer to Second Amended Complaint Civil Action No. 6:20-cv-00069-ADA; dated May 26, 2020; 18 pages.
Farinago, et al.; Long Gun Deployment Systems IPS-12-28; presented at International Perforating Symposium, Apr. 26-28, 2012; 11 pages.
GB Intellectual Property Office, Combined Search and Examination Report for GB App. No. 1717516.7, dated Feb. 27, 2018, 6 pgs.
GB Intellectual Property Office, Combined Search and Examination Report for GB App. No. GB1700625.5, dated Jul. 7, 2017, 5 pages.
Hunting Titan Ltd,; Defendants' Answer and Counterclaims, Civil Action No. 4:19-cv-01611, consolidated to Civil Action No. 4:17-cv-03784; dated May 28, 2019; 21 pages.
Hunting Titan Ltd.; Petition for Inter Partes Review of U.S. Pat. No. 9,581,422 Case No. IPR2018-00600; dated Feb. 16, 2018; 93 pages.
Hunting Titan Ltd.; Defendants' Answer and Counterclaims, Civil Action No. 6:20-cv-00069; dated Mar. 17, 2020; 30 pages.
Hunting Titan Ltd.; Defendants' Answer to First Amended Complaint and Counterclaims, Civil Action No. 6:20-cv-00069; dated Apr. 6, 2020; 30 pages.
Hunting Titan Ltd.; Defendants' Answer to Second Amended Complaint and Counterclaims, Civil Action No. 6:20-cv-00069; dated May 12, 2020; 81 pages.
Hunting Titan Ltd.; Defendants Invalidity Contentions Pursuant to Patent Rule 3-3, Civil Action No. 4:17-cv-03784; dated Jul. 6, 2018; 29 pages.
Hunting Titan Ltd.; Defendants' Objections and Responses to Plaintiffs' First Set of Interrogatories, Civil Action No. 4:17-cv-03784; dated Jun. 11, 2018.
Hunting Titan Ltd.; Defendants' Opposition to Plaintiffs' Motion to Dismiss and Strike Defendants' Amended Counterclaim and Affirmative Defenses for Unenforceability due to Inequitable Conduct for Civil Action No. 4:17-cv-03784; dated Apr. 24, 2018; 8 pages.
International Search Report and Written Opinion of International App. No. PCT/EP2020/058241, dated Aug. 10, 2020,which is in the same family as U.S. Appl. No. 16/542,890, 18 pgs.
merriam-webster.com, Insulator Definition, https://www.merriam-webster.com/dictionary/insulator, Jan. 31, 2018, 4 pages.
Parrot, Robert; Declaration, PGR 2020-00080; dated Aug. 11, 2020; 400 pages.
Schlumberger; Selective Perforation: A Game Changer in Perforating Technology—Case Study; issued 2012; 14 pages.
United States District Court for the Southern District of Texas Houston Division, Case 4:19-cv-01611 for U.S. Pat. No. 9,581,422 B2, Plaintiff's Complaint and Exhibits, dated May 2, 2019, 26 pgs.
United States District Court for the Southern District of Texas Houston Division, Case 4:19-cv-01611 for U.S. Pat. No. 9,581,422 B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422 B2, Plaintiffs' Motion to Dismiss and Exhibits, dated Jun. 17, 2019, 63 pgs.
United States Patent and Trademark Office, Notice of Allowance for U.S. Appl. No. 16/585,790, dated Jun. 19, 2020, 16 pgs.
WIPO, Written Opinion of International Searching Authority for PCT Application No. PCT/CA2014/050673, dated Oct. 9, 2014, 4 pgs.
United States Patent and Trademark Office; Notice of Allowance for U.S. Appl. No. 29/733,080; dated Oct. 20, 2020; 9 pages.
United States Patent and Trademark Office; Notice of Allowance for U.S. Appl. No. 15/920,812, dated Aug. 18, 2020; 5 pages.
United States Patent and Trademark Office; Notice of Allowance for U.S. Appl. No. 16/585,790, dated Aug. 5, 2020; 15 pages.
United States Patent and Trademark Office; Office Action of U.S. Appl. No. 16/540,484, dated Aug. 20, 2020, 10 pgs.
United States Patent and Trial Appeal Board; Final Written Decision on IPR2018-00600; issued Aug. 20, 2019; 31 pages.
USPTO, U.S. Pat. No. 438,305 A, issued on Oct. 14, 1890 to T.A. Edison, 2 pages.
WIPO, International Search Report for International Application No. PCT/CA2014/050673, dated Oct. 9, 2014, 3 pgs.

(56) References Cited

OTHER PUBLICATIONS

United States Patent and Trademark Office; Non-Final Office Action for U.S. Appl. No. 29/733,325; dated Jun. 26, 2020.
United States Patent and Trademark Office; Notice of Allowance for U.S. Appl. No. 15/920,800; dated Jul. 7, 2020; 7 pages.
United States Patent and Trademark Office; Notice of Allowance for U.S. Appl. No. 16/423,789; dated Jul. 23, 2020 7 pages.
Baker Hughes; SurePeif Rapid Select-Fire System Perforate production zones in a single run; 2012; 2 pages.
DynaEnergetics Europe GMBH; Patent Owner's Preliminary Response for PGR2020-00072; dated Oct. 23, 2020; 108 pages.
DynaEnergetics Europe GMBH; Patent Owner's Preliminary Response for PGR2020-00080; dated Nov. 18, 2020; 119 pages.
DynaEnergetics Europe; Complaint and Demand for Jury Trial, Civil Action No. 6:20-cv-1110; dated Dec. 4, 2020; 15 pages.
DynaEnergetics Europe; DynaEnergetics exhibition and product briefing; 2013; 15 pages.
DynaEnergetics Europe; DynaStage Gun System; May 2014; 2 pages.
Hunting Titan; ControlFire RF-Safe Assembly Gun Loading Manual; 33 pages.
Hunting Titan; ControlFire User Manual; 2014; 56 pages.
International Searching Authority; International Preliminary Report on Patentability for International Application No. PCT/IB2019/000537; dated Dec. 10, 2020; 11 pages.
Rodgers, John; Declaration for PGR2020-00072; dated Oct. 23, 2020; 116 pages.
Rodgers, John; Declaration for PGR2020-00080; dated Nov. 18, 2020; 142 pages.
Scharf Thilo; Declaration for PGR2020-00080; dated Nov. 16, 2020; 16 pages.
Scharf, Thilo; Declaration for PGR2020-00072; dated Oct. 22, 2020; 13 pages.
United States Patent and Trademark Office; Non-Final Office Action of U.S. Appl. No. 15/920,800; dated Dec. 9, 2020; 6 pages.
United States Patent and Trademark Office; Restriction Requirement for U.S. Appl. No. 17/007,574; dated Oct. 23, 2020; 6 pages.
U.S. Appl. No. 29/729,981, filed Mar. 31, 2020, Eric Mulhern.
Brazilian Patent and Trademark Office; Search Report for BR Application No. BR112015033010-0; dated May 5, 2020; (4 pages).
Burndy, Bulkhead Ground Connector, Mechanical Summary Sheet, The Grounding Superstore, Jul. 15, 2014, 1 page, https://www.burndy.com/docs/default-source/cutsheets/bulkhead-connect.
Canadian Intellectual Property Office, Office Action for CA App. No. 2923860 dated Jul. 14, 2017, 3 pages.
Canadian Intellectual Property Office, Office Action for CA App. No. 2923860 dated Nov. 25, 2016, 3 pages.
Canadian Intellectual Property Office; Notice of Allowance for CA Appl. No. 2,821,506; dated Jul. 31, 2019; 1 page.
Canadian Intellectual Property Office; Office Action for CA Appl. No. 2,821,506; dated Mar. 21, 2019; 4 pages.
Dalia Abdallah et al., Casing Corrosion Measurement to Extend Asset Life, Dec. 31, 2013, 14 pgs., https://www.slb.com/-/media/files/oilfield-review/2-casing-corr-2-english.
Djresource, Replacing Signal and Ground Wire, May 1, 2007, 2 pages, http://www.djresource.eu/Topics/story/110/Technics-SL-Replacing-Signal-and-Ground-Wire/.
DynaEnergetics, Electronic Top Fire Detonator, Product Information Sheet, Jul. 30, 2013 1 pg.
DynaEnergetics; DynaStage Solution—Factory Assembled Performance-Assured Perforating Systems; 6 pages.
EP Patent Office—International Searching Authority, PCT Search Report and Written Opinion for PCT Application No. PCT/EP2014/065752, dated May 4, 2015, 12 pgs.
Eric H. Findlay, Jury Trial Demand in Civil Action No. 6:20-cv-00069-ADA, dated Apr. 22, 2020, 32 pages.
European Patent Office; International Search Report and Written Opinion for PCT Application No. PCT/EP2014/065752 dated May 4, 2015; 12 pgs.
European Patent Office; Invitation to Correct Deficiencies noted in the Written Opinion for European App. No. 15721178.0; dated Dec. 13, 2016; 2 pages.
European Patent Office; Office Action for EP App. No. 15721178.0; dated Sep. 6, 2018; 5 pages.
Federal Institute of Industrial Property; Decision of Granting for RU Appl. No. 2016104882/03(007851); dated May 17, 2018; 15 pages (English translation 4 pages).
Federal Institute of Industrial Property; Decision on Granting a Patent for Invention Russian App. No. 2016139136/03(062394); dated Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); dated Feb. 1, 2018; 6 pages (Eng. Translation 4 pages).
GB Intellectual Property Office; Examination Report for GB Appl. No. 1717516.7; dated Apr. 13, 2018; 3 pages.
GB Intellectual Property Office; Notification of Grant for GB Appl. No. 1717516.7; dated Oct. 9, 2018; 2 pages.
GB Intellectual Property Office; Search Report for GB. Appl. No. 1700625.5; dated Dec. 21, 2017; 5 pages.
Industrial Property Office, Czech Republic; Office Action for CZ App. No. PV 2017-675; dated Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; dated Oct 26, 2018; 2 pages.
Industrial Property Office, Czech Republic; Office Action; CZ App. No. PV 2017-675; ated Dec 17, 2018; 2 pages.
International Searching Authority, International Preliminary Report on Patentability for PCT App. No. PCT/EP2014/065752; dated Mar. 1, 2016, 10 pgs.
International Searching Authority; International Preliminary Report on Patentability for PCT Appl. No. PCT/CA2014/050673; dated Jan. 19, 2016; 5 pages.
International Searching Authority; International Search Report and Written Opinion for PCT App. No. PCT/EP2015/059381; dated Nov. 23, 2015; 14 pages.
Jet Research Centers, Capsule Gun Perforating Systems, Alvarado, Texas, 26 pgs., https://www.jetresearch.com/content/dam/jrc/Documents/Books_Catalogs/07_Cap_Gun.pdf.
McNelis et al.; High-Performance Plug-and-Perf Completions in Unconventional Wells; Society of Petroleum Engineers Annual Technical Conference and Exhibition; Sep. 28, 2015.
Norwegian Industrial Property Office; Office Action for NO Appl. No. 20160017; dated Dec. 4, 2017; 2 pages.
Norwegian Industrial Property Office; Opinion for NO Appl. No. 20171759; dated Apr. 5, 2019; 1 page.
Owen Oil Tools, E & B Select Fire Side Port, Tandem Sub, Apr. 2010, 2 pgs., https://www.corelab.com/owen/cms/docs/Canada/10A_eandbsystem-01.0-c.pdf.
Owen Oil Tools, Expendable Perforating Guns, Jul. 2008, 7 pgs., https://www.corelab.com/owen/cms/docs/Canada/10A_erhsc-01.0-c.pdf.
Owens Oil Tools, E & B Select Fire Side Port Tandem Sub Assembly, 2009, 9 pgs., https://www.corelab.com/owen/CMS/docs/Manuals/gunsys/MAN-30-XXX-0002-96-R00.pdf.
Robert Parrott, Case IPR2018-00600 for U.S. Pat. No. 9,581,422 B2, Declaration regarding Patent Invalidity, dated Jun. 29, 2020, 146 pages.
State Intellectual Property Office People's Republic of China; First Office Action for Chinese App. No. 201811156092.7; dated Jun. 16, 2020; 6 pages (Eng Translation 8 pages).
State Intellectual Property Office, P.R. China; First Office Action for CN App. No. 201480047092.7; dated Apr. 24, 2017.

(56) References Cited

OTHER PUBLICATIONS

State Intellectual Property Office, P.R. China; First Office Action with full translation for CN App. No. 201480040456.9; dated Mar. 29, 2017; 12 pages (English translation 17 pages).
State Intellectual Property Office, P.R. China; Notification to Grant Patent Right for Chinese App. No. 201580011132.1; dated Apr. 3, 2019; 2 pages (Eng. Translation 2 pages).
State Intellectual Property Office, P.R. China; Notification to Grant Patent Right for CN App. No. 201480040456.9; dated Jun. 12, 2018; 2 pages (English translation 2 pages).
State Intellectual Property Office, P.R. China; Second Office Action for CN App. No. 201480040456.9; dated Nov. 29, 2017; 5 pages (English translation 1 page).
State Intellectual Property Office, P.R. China; Second Office Action for CN App. No. 201480047092.7; dated Jan. 4, 2018; 3 pages.
United States Patent and Trademark Office, Case IPR2018-00600 for U.S. Pat. No. 9,581,422 B2, Patent Owner's Decision, Granting Patent Owner's Request for Hearing and Granting Patent Owner's Motion to Amend, dated Jul. 6, 2020, 27 pgs.
United States Patent and Trademark Office, Case PGR 2020-00072 for U.S. Pat. No. 10,429,161 B2, Petition for Post Grant Review of Claims 1-20 of U.S. Pat. No. 10,429,161 Under 35 U.S.C. §§ 321-28 and 37 C.F.R. §§42.200 ET SEQ., dated Jun. 30, 2020, 109 pages.
United States Patent and Trademark Office, Office Action of U.S. Appl. No. 14/767,058, dated Jul. 15, 2016, 9 pgs.
United States Patent and Trademark Office, Office Action of U.S. Appl. No. 15/117,228, dated May 31, 2018, 9 pgs.
United States Patent and Trademark Office, Office Action of U.S. Appl. No. 15/617,344, dated Jan. 23, 2019, 5 pgs.
United States Patent and Trademark Office, Office Action of U.S. Appl. No. 15/788,367, dated Oct. 22, 2018, 6 pgs.
United States Patent and Trademark Office, Office Action of U.S. Appl. No. 15/920,800, dated Dec. 27, 2019, 6 pgs.
Hunting Titan Inc.; Petition for Post Grant Review of U.S. Pat. No. 10,472,938; dated Aug. 12, 2020; 198 pages.
DynaEnergetics, Selection Perforating Switch, Product Information Sheet, May 27, 2011, 1 pg.
German Patent Office, Office Action dated May 22, 2014, in German: See Office Action for German Patent Application No. 10 2013 109 227.6, which is in the same family as PCT Application No. PCT/EP2014/065752, 8 pgs.
PCT Search Report and Written Opinion, dated May 4, 2015: See Search Report and Written opinion for PCT Application No. PCT/EP2014/065752, 12 pgs.
SIPO, Search Report dated Mar. 29, 2017, in Chinese: See Search Report for CN App. No. 201480040456.9, which is in the same family as PCT App. No. PCT/CA2014/050673, 12 & 3 pgs.
Jim Gilliat/Kaled Gasmi, New Select-Fire System, Baker Hughes, Presentation—2013 Asia-Pacific Perforating Symposium, Apr. 29, 2013, 16 pgs., http://www.perforators.org/presentations.php.
DynaEnergetics, DYNAselect Electronic Detonator 0015 SFDE RDX 1.4S, Product Information, Dec. 16, 2011, 1 pg.
DynaEnergetics, DYNAselect Electronic Detonator 0015 SFDE RDX 1.4B, Product Information, Dec. 16, 2011, 1 pg.
Norwegian Industrial Property Office, Office Action for NO Patent App. No. 20171759, dated Jan. 14, 2020, 4 pgs.
Norwegian Industrial Property Office, Search Report for NO Patent App. No. 20171759, dated Jan. 14, 2020, 2 pgs.
International Search Report and Written Opinion of International App. No. PCT/EP2019/072064, dated Nov. 20, 2019, 15 pgs.
Johnson, Bryce; Citation of Prior Art and Written Statements in Patent Files for U.S. Pat. No. 10,844,697; dated Apr. 29, 2021; 2 pages.
Johnson, Bryce; Rule 501 citation of prior art and written "claim scope statements" in U.S. Pat. No. 10,844,697 dated Apr. 29, 2021; 18 pages.
*GR Energy Operating GP LLC, GR Energy Services Management, LP and GR Energy Services, LLC*; Exhibit L U.S. Pat. No. 10,844,697 vs *Boop* '383; dated Aug. 30, 2021; 24 pages.
*GR Energy Operating GP LLC, GR Energy Services Management, LP and GR Energy Services, LLC*; Exhibit M U.S. Pat. No. 10,844,697 vs *Boop* '992; dated Aug. 30, 2021; 14 pages.
*GR Energy Operating GP LLC, GR Energy Services Management, LP and GR Energy Services, LLC*; Exhibit N U.S. Pat. No. 10,844,697 vs *Deere*; dated Aug. 30, 2021; 14 pages.
*GR Energy Operating GP LLC, GR Energy Services Management, LP and GR Energy Services, LLC*; ; Exhibit O U.S. Pat. No. 10,844,697 vs *Harrigan* Provisional; dated Aug. 30, 2021; 26 pages.
*GR Energy Operating GP LLC, GR Energy Services Management, LP and GR Energy Services, LLC*; Exhibit P U.S. Pat. No. 10,844,697 vs *Burke* '251; dated Aug. 30, 2021; 7 pages.
*GR Energy Operating GP LLC, GR Energy Services Management, LP and GR Energy Services, LLC*; Exhibit Q U.S. Pat. No. 10,844,697 vs *Runkel*; dated Aug. 30, 2021; 7 pages.
*GR Energy Operating GP LLC, GR Energy Services Management, LP and GR Energy Services, LLC*; Exhibit R U.S. Pat. No. 10,844,697 vs *Tassaroli*; dated Aug. 30, 2021; 10 pages.
*GR Energy Operating GP LLC, GR Energy Services Management, LP and GR Energy Services, LLC*; Exhibit S U.S. Pat. No. 10,844,697 vs *Harrigan* '048; dated Aug. 30, 2021; 7 pages.
*GR Energy Operating GP LLC, GR Energy Services Management, LP and GR Energy Services, LLC*; Exhibit T U.S. Pat. No. 10,844,697 vs *Select-Fire System*; dated Aug. 30, 2021; 36 pages.
*GR Energy Operating GP LLC, GR Energy Services Management, LP and GR Energy Services, LLC*; Exhibit U U.S. Pat. No. 10,844,697 vs *New Select-Fire System*; dated Aug. 30, 2021; 37 pages.
*GR Energy Operating GP LLC, GR Energy Services Management, LP and GR Energy Services, LLC*; Exhibit V U.S. Pat. No. 10,844,697 vs *EWAPS*; dated Aug. 30, 2021; 17 pages.
*GR Energy Operating GP LLC, GR Energy Services Management, LP and GR Energy Services, LLC*; Exhibit W U.S. Pat. No. 10,844,697 vs *SafeJet System*; dated Aug. 30, 2021; 17 pages.
GR Energy Operating GP LLC, GR Energy Services Management, LP and GR Energy Services, LLC; GR Energy's Preliminary Invalidity Contentions for Civil Action No. 6:21-cv-00085-ADA; dated Aug. 30, 2021; 18 pages.
Heard, Preston; Declaration for PGR2021-00078; dated Aug. 19, 2021; 5 pages.
Horizontal Wireline Services, LLC and Allied Wireline Services, LLC; Defendants' Preliminary Invalidity Contentions for Civil Action No. 6:21-cv-00349-ADA; dated Aug. 30, 2021; 22 pages.
Horizontal Wireline Services, LLC and Allied Wireline Services, LLC; Exhibit A1 U.S. Pat. No. 5,155,293 to Barton vs. Asserted Claims of U.S. Pat. No. 10,844,697; dated Aug. 30, 2021; 21 pages.
Horizontal Wireline Services, LLC and Allied Wireline Services, LLC; Exhibit A10 U.S. Publication No. 8,869,887 to Deere, et al. vs. Asserted Claims of U.S. Pat. No. 10,844,697; dated Aug. 30, 2021; 10 pages.
Horizontal Wireline Services, LLC and Allied Wireline Services, LLC; Exhibit A11 U.S. Pat. No. 1,457,383 to Boop vs. Asserted Claims of U.S. Pat. No. 10,844,697; dated Aug. 30, 2021; 22 pages.
Horizontal Wireline Services, LLC and Allied Wireline Services, LLC; Exhibit A12 U.S. Patent Application Pub. No. 2012/0247771 to Black, et al. vs. Asserted Claims of U.S. Pat. No. 10,844,697; dated Aug. 30, 2021; 26 pages.
Horizontal Wireline Services, LLC and Allied Wireline Services, LLC; Exhibit A13 U.S. Publication No. 2016/0084048 to Harrigan, et al. vs. Asserted Claims of U.S. Pat. No. 10,844,697; dated Aug. 30, 2021; 14 pages.
Horizontal Wireline Services, LLC and Allied Wireline Services, LLC; Exhibit A14 U.S. Patent Application No. 2010/0065302 to Nesbitt vs. Asserted Claims of U.S. Pat. No. 10,844,697; dated Aug. 30, 2021 15 pages.
Horizontal Wireline Services, LLC and Allied Wireline Services, LLC; Exhibit A15 U.S. Pat. No. 3,173,992 to Boop vs. Asserted Claims of U.S. Pat. No. 10,844,697; dated Aug. 30, 2021; 17 pages.
Horizontal Wireline Services, LLC and Allied Wireline Services, LLC; Exhibit A16 U.S. Pat. No. 6,506,083 to Bickford, et al. vs. Asserted Claims of U.S. Pat. No. 10,844,697; dated Aug. 30, 2021; 17 pages.

(56) References Cited

OTHER PUBLICATIONS

Horizontal Wireline Services, LLC and Allied Wireline Services, LLC; Exhibit A17 U.S. Pat. No. 8,387,533 to Runkel vs. Asserted Claims of U.S. Pat. No. 10,844,697; dated Aug. 30, 2021; 16 pages.
Horizontal Wireline Services, LLC and Allied Wireline Services, LLC; Exhibit A18 U.S. Pat. No. 8,943,943 to Tassaroli vs. Asserted Claims of U.S. Pat. No. 10,844,697; dated Aug. 30, 2021; 7 pages.
Horizontal Wireline Services, LLC and Allied Wireline Services, LLC; Exhibit A19 U.S. Pat. No. 7,762,331 to Goodman vs. Asserted Claims of U.S. Pat. No. 10,844,697; dated Aug. 30, 2021; 28 pages.
Horizontal Wireline Services, LLC and Allied Wireline Services, LLC; Exhibit A2 U.S. Pat. No. 6,582,251 to Burke, et al. vs. Asserted Claims of U.S. Pat. No. 10,844,697; dated Aug. 30, 2021; 15 pages.
Horizontal Wireline Services, LLC and Allied Wireline Services, LLC; Exhibit A20 U.S. Patent Application No. 2012/0199352 to Lanclos vs. Asserted Claims of U.S. Pat. No. 10,844,697; dated Aug. 30, 2021; 24 pages.
Horizontal Wireline Services, LLC and Allied Wireline Services, LLC; Exhibit A21 "3.12-in Frac Gun" Publication and 3.12-in Frac Gun System, both by Schlumberger vs. Asserted Claims of U.S. Pat. No. 10,844,697; dated Aug. 30, 2021; 26 pages.
Horizontal Wireline Services, LLC and Allied Wireline Services, LLC; Exhibit A22 "New Select-Fire System" Publication and Select-Fire System, both by BakerHughes vs. Asserted Claims of U.S. Pat. No. 10,844,697; dated Aug. 30, 2021; 14 pages.
Horizontal Wireline Services, LLC and Allied Wireline Services, LLC; Exhibit A23 Amit Govil, "Selective Perforation: A Game Changer in Perforating Technology—Case Study," 2012 European and West African Perforating Symposium vs. Asserted Claims of U.S. Pat. No. 10,844,697; dated Aug. 30, 2021; 17 pages.
Horizontal Wireline Services, LLC and Allied Wireline Services, LLC; Exhibit A24 Schlumberger SafeJet System vs. Asserted Claims of U.S. Pat. No. 10,844,697; dated Aug. 30, 2021; 26 pages.
Horizontal Wireline Services, LLC and Allied Wireline Services, LLC; Exhibit A3 U.S. Pat. No. 7,901,247 to Ring vs. Asserted Claims of U.S. Pat. No. 10,844,697; dated Aug. 30, 2021; 19 pages.
Horizontal Wireline Services, LLC and Allied Wireline Services, LLC; Exhibit A4 U.S. Pat. No. 9,145,764 to Burton, et al. vs. Asserted Claims of U.S. Pat. No. 10,844,697; dated Aug. 30, 2021; 18 pages.
Horizontal Wireline Services, LLC and Allied Wireline Services, LLC; Exhibit A5 U.S. Pat. No. 9,175,553 to Mcann, et al. vs. Asserted Claims of U.S. Pat. No. 10,844,697; dated Aug. 30, 2021; 26 pages.
Horizontal Wireline Services, LLC and Allied Wireline Services, LLC; Exhibit A6 U.S. Pat. No. 9,689,223 to Schacherer vs. Asserted Claims of U.S. Pat. No. 10,844,697; dated Aug. 30, 2021; 8 pages.
Horizontal Wireline Services, LLC and Allied Wireline Services, LLC; Exhibit A7 International (PCT) Publication No. WO2014/089194 to Rogman, et al. vs. Asserted Claims of U.S. Pat. No. 10,844,697; dated Aug. 30, 2021; 16 pages.
Horizontal Wireline Services, LLC and Allied Wireline Services, LLC; Exhibit A8 U.S. Patent Application Pub. No. 2008/0073081 to Frazier, et al. vs. Asserted Claims of U.S. Pat. No. 10,844,697; dated Aug. 30, 2021; 33 pages.
Horizontal Wireline Services, LLC and Allied Wireline Services, LLC; Exhibit A9 U.S. Pat. No. 9,065,201 to Borgfeld, et al. vs. Asserted Claims of U.S. Pat. No. 10,844,697; dated Aug. 30, 2021; 14 pages.
Hunting Titan, Inc.; Defendant's Answer, Affirmative Defenses, and Counterclaims to Plaintiffs' Second Amended Complaint for Civil Action No. 4:20-cv-02123; dated Sep. 10, 2021; 77 pages.
Hunting Titan, Inc; Petitioner's Sur-Reply on Patent Owner's Motion to Amend for IPR No. 2018-00600; dated Apr. 11, 2019; 17 pages.
Hunting Titan; ControlFire; dated Jan. 5, 2017; 20 pages; http://www.hunting-intl.com/media/2666029/Hunting%20ControlFire%20Presentation_Public11.pdf.
Hunting; Payload: Preloaded Perforating Guns; 2 pages; http://www.hunting-intl.com/titan/perforating-guns/payload-preloaded-perforating-guns.
JPT; New Instrumented Docketing Gun System Maximizes Perforating Performance; dated Aug. 31, 2018 7 pages; https://jpt.spe.org/new-instrumented-docking-gun-system-maximizes-perforating-performance.
Logan, et al.; International Patent Application No. PCT/CA2013/050986; dated Dec. 18, 2013; 54 pages.
Markel, Dan; Declaration regarding the SafeJet System for PGR2021-00097; dated Jul. 15, 2021; 21 pages.
New Oxford American Dictionary Third Edition; Definition of "end"; dated 2010; 3 pages.
Nextier Completion Solutions Inc.; Defendant Nextier Completion Solutions Inc.'s First Amended Answer and Counterclaims to Plaintiffs' First Amended Complaint for Civil Action No. 6:20-CV-01201; dated Jun. 28, 2021; 17 pages.
Nextier Completion Solutions Inc.; Defendant's Preliminary Invalidity Contentions for Civil Action No. 6:20-cv-01201-ADA; dated Aug. 30, 2021; 21 pages.
Nextier Completion Solutions Inc.; Exhibit A-1 BakerHughes Select-Fire; dated Aug. 30, 2021; 33 pages.
Bear Manufacturing, LLC; Defendant Bear Manufacturing, LLC's Answer, Affirmative Defenses and Counterclaim in Response to Plaintiffs' Complaint for Civil Action No. 3:21-cv-00185-M; dated Mar. 22, 2021; 41 pages.
Bear Manufacturing, LLC; Defendant's Preliminary Invalidity Contentions; dated Aug. 4, 2021; 23 pages.
Bear Manufacturing, LLC; Exhibit A16 U.S. Pat. No. 6,506,083 to Bickford, et al vs. Asserted Claims of U.S. Pat. No. 10,844,697; dated Aug. 4, 2021; 17 pages.
Bear Manufacturing, LLC; Exhibit A18 U.S. Pat. No. 8,943,943 to Tassaroli vs. Asserted Claims of U.S. Pat. No. 10,844,697; dated Aug. 4, 2021; 7 pages.
Bear Manufacturing, LLC; Exhibit A19 U.S. Pat. No. 7,762,331 to Goodman vs. Asserted Claims of U.S. Pat. No. 10,844,697; dated Aug. 4, 2021; 28 pages.
Bear Manufacturing, LLC; Exhibit A1 U.S. Pat. No. 5,155,293 to Barton vs. Asserted Claims of U.S. Pat. No. 10,844,697; dated Aug. 4, 2021; 21 pages.
Bear Manufacturing, LLC; Exhibit A10 U.S. Pat. No. 8,869,887 to Deere, et al vs. Asserted Claims of U.S. Pat. No. 10,844,697; dated Aug. 4, 2021; 10 pages.
Bear Manufacturing, LLC; Exhibit A11 U.S. Pat. No. 4,457,383 to Boop vs. Asserted Claims of U.S. Pat. No. 10,844,697; dated Aug. 4, 2021; 22 pages.
Bear Manufacturing, LLC; Exhibit A12 U.S. Publication No. 2012/0247771 to Black, et al vs. Asserted Claims of U.S. Pat. No. 10,844,697; dated Aug. 4, 2021; 26 pages.
Bear Manufacturing, LLC; Exhibit A13 U.S. Publication No. 2016/0084048 to Harrigan, et al vs. Asserted Claims of U.S. Pat. No. 10,844,697; dated Aug. 4, 2021; 14 pages.
Bear Manufacturing, LLC; Exhibit A15 U.S. Pat. No. 3,173,992 to Boop vs. Asserted Claims of U.S. Pat. No. 10,844,697; dated Aug. 4, 2021; 17 pages.
Bear Manufacturing, LLC; Exhibit A17 U.S. Pat. No. 8,387,533 to Runkel vs. Asserted Claims of U.S. Pat. No. 10,844,697; dated Aug. 4, 2021; 16 pages.
Bear Manufacturing, LLC; Exhibit A2 U.S. Pat. No. 6,582,251 to Burke, et al vs. Asserted Claims of U.S. Pat. No. 10,844,697; dated Aug. 4, 2021; 15 pages.
Bear Manufacturing, LLC; Exhibit A20 U.S. Publication 2012/0199352 to Lanclos vs. Asserted Claims of U.S. Pat. No. 10,844,697; dated Aug. 4, 2021; 24 pages.
Bear Manufacturing, LLC; Exhibit A21 "3.12-in Frac Gun" Publication and 3.12-in Frac Gun System by Sclumberger vs. Asserted Claims of U.S. Pat. No. 10,844,697; dated Aug. 4, 2021; 26 pages.
Bear Manufacturing, LLC; Exhibit A22 "New Select-Fire System" Publication and Select-Fire System by BakerHughes vs. Asserted Claims of U.S. Pat. No. 10,844,697; dated Aug. 4, 2021; 14 pages.
Bear Manufacturing, LLC; Exhibit A23 Amit Govil, "Selective Perforation: A Game Changer in Perforating Technology—Case

(56) References Cited

OTHER PUBLICATIONS

Study," 2012 European and West African Perforating Symposium ("EWAPS") vs. Asserted Claims of U.S. Pat. No. 10,844,697; dated Aug. 4, 2021; 17 pages.
Bear Manufacturing, LLC; Exhibit A24 Schlumberger SafeJet System vs. Asserted Claims of U.S. Pat. No. 10,844,697; dated Aug. 4, 2021; 26 pages.
Bear Manufacturing, LLC; Exhibit A3 U.S. Pat. No. 7,901,247 to Ring vs. Asserted Claims of U.S. Pat. No. 10,844,697; dated Aug. 4, 2021; 19 pages.
Bear Manufacturing, LLC; Exhibit A4 U.S. Pat. No. 9,145,764 to Burton, et al. vs. Asserted Claims of U.S. Pat. No. 10,844,697; dated Aug. 4, 2021; 18 pages.
Bear Manufacturing, LLC; Exhibit A5 U.S. Pat. No. 9,175,553 to McCann, et al vs. Asserted Claims of U.S. Pat. No. 10,844,697; dated Aug. 4, 2021; 26 pages.
Bear Manufacturing, LLC; Exhibit A6 U.S. Pat. No. 9,689,223 to Schacherer, et al vs. Asserted Claims of U.S. Pat. No. 10,844,697; dated Aug. 4, 2021; 8 pages.
Bear Manufacturing, LLC; Exhibit A7 WO 2014/089194 to Rogman, et al vs. Asserted Claims of U.S. Pat. No. 10,844,697; dated Aug. 4, 2021; 16 pages.
Bear Manufacturing, LLC; Exhibit A8 U.S. Publication No. 2008/0073081 to Frazier, et al. vs. Asserted Claims of U.S. Pat. No. 10,844,697; dated Aug. 4, 2021; 33 pages.
Bear Manufacturing, LLC; Exhibit A9 U.S. Pat. No. 9,065,201 to Borgfeld, et al vs. Asserted Claims of U.S. Pat. No. 10,844,697; dated Aug. 4, 2021; 14 pages.
Bear Manufacturing, LLLC; Exhibit A14 U.S. Publication No. 2010/0065302 to Nesbitt vs. Asserted Claims of U.S. Patent No. 10,844,697; dated Aug. 4, 2021; 15 pages.
drillingmatters.org; Definition of "sub"; dated Aug. 25, 2018; 2 pages.
DynaEnergetics Europe GMBH; Patent Owner's Preliminary Response for PGR2021-00078; dated Aug. 19, 2021; 114 pages.
DynaEnergetics Europe GMBH; Plaintiffs Preliminary Infringement Contentions for Civil Action No. 6:21-cv-01 110; dated Jul. 6, 2021; 6 pages.
DynaEnergetics Europe, GMBH; DynaEnergetics' Preliminary Claim Construction and Extrinsic Evidence for Civil Action No. 4:21-cv-00280; dated Aug. 4, 2021; 10 pages.
DynaEnergetics Europe; Plaintiffs Preliminary Infringment Contentions Civil Action No. 3:21-cv-00192-M; dated Jun. 18, 2021; 15 pages.
G&H Diversified Manufacturing, LP and DynaEnergetics Europe GMBH; Joint Claim Construction Statement for Civil Action No. 3:20-cv-00376; dated Jul. 8, 2021; 14 pages.
G&H Diversified Manufacturing, LP; Defendant G&H Diversified Manufacturing, LP's Answer to Counter-Claim Plaintiffs' Counter-Claims for Civil Action No. 3:20-cv-00376; dated Apr. 19, 2021; 13 pages.
G&H Diversified Manufacturing, LP; Defendants' Preliminary Invalidity Contentions for Civil Action No. 3:20-cv-00376; dated May 6, 2021; 20 pages.
G&H Diversified Manufacturing, LP; Plaintiff and Counterclaim Defendant G&H Diversified Manufacturing, LP and Counterclaim Defendant Yellow Jacket Oil Tools, LLC's Proposed Constructions; dated Jun. 10, 2021; 7 pages.
G&H Diversified Manufacturing, LP; Plaintiff and Counterclaim Defendant G&H Diversified Manufacturing, LP and Counterclaim Defendant Yellow Jacket Oil Tools, LLC's First Supplemental Proposed Constructions; dated Jun. 24, 2021; 7 pages.
G&H Diversified Manufacturing, LP; Redated Petition for Post Grant Review for PGR2021-00078; dated May 10, 2021; 20 pages.
G&H Diversified Manufacturing, LP; Reply to Preliminary Response for PGR No. PGR2021-00078; dated Sep. 14, 2021; 18 pages.
GeoDynamics; Perforating Catalog; dated Mar. 5, 2020; 218 pages; https://www.perf.com/hubfs/PDF%20Files/PerforatingCatalog_03272020_SMS.pdf.
*GR Energy Operating GP LLC, GR Energy Services Management, LP and GR Energy Services, LLC*; Exhibit A U.S. Pat. No. 10,844,697 vs *Castel*; dated Aug. 30, 2021; 88 pages.
*GR Energy Operating GP LLC, GR Energy Services Management, LP and GR Energy Services, LLC*; Exhibit B U.S. Pat. No. 10,844,697 vs *Goodman*; dated Aug. 30, 2021; 36 pages.
*GR Energy Operating GP LLC, GR Energy Services Management, LP and GR Energy Services, LLC*; Exhibit C U.S. Pat. No. 10,844,697 vs *Hromas*; dated Aug. 30, 2021; 27 pages.
*GR Energy Operating GP LLC, GR Energy Services Management, LP and GR Energy Services, LLC*; Exhibit D U.S. Pat. No. 10,844,697 vs *Boop* 768; dated Aug. 30, 2021; 35 pages.
*GR Energy Operating GP LLC, GR Energy Services Management, LP and GR Energy Services, LLC*; Exhibit E U.S. Pat. No. 10,844,697 vs *Boop* 792; dated Aug. 30, 2021; 52 pages.
*GR Energy Operating GP LLC, GR Energy Services Management, LP and GR Energy Services, LLC*; Exhibit F U.S. Pat. No. 10,844,697 vs *Boop* 378; dated Aug. 30, 2021; 34 pages.
*GR Energy Operating GP LLC, GR Energy Services Management, LP and GR Energy Services, LLC*; Exhibit G U.S. Pat. No. 10,844,697 vs *Bickford*; dated Aug. 30, 2021; 7 pages.
*GR Energy Operating GP LLC, GR Energy Services Management, LP and GR Energy Services, LLC*; Exhibit H U.S. Pat. No. 10,844,697 vs *Black*; dated Aug. 30, 2021; 33 pages.
*GR Energy Operating GP LLC, GR Energy Services Management, LP and GR Energy Services, LLC*; Exhibit I U.S. Pat. No. 10,844,697 vs *Rogman*; dated Aug. 30, 2021; 59 pages.
*GR Energy Operating GP LLC, GR Energy Services Management, LP and GR Energy Services, LLC*; Exhibit J U.S. Pat. No. 10,844,697 vs *Burton*; dated Aug. 30, 2021; 57 pages.
*GR Energy Operating GP LLC, GR Energy Services Management, LP and GR Energy Services, LLC*; Exhibit K U.S. Pat. No. 10,844,697 vs *Borgfeld*; dated Aug. 30, 2021; 36 pages.
CoreLab Quick Change Assembly; Exhibit No. 1034 of PGR No. 2021-00078; dated Aug. 2002; 1 page.
DynaEnergetics Europe; Defendants' Preliminary Infringement Contentions for Civil Action No. 3:20-CV-00376; dated Mar. 25, 2021; 22 pages.
DynaEnergetics Europe; DynaEnergetics Europe GMBH and DynaEnergetics US, Inc.'s Answer to Complaint and Counterclaim Civil Action No. 3:20-cv-000376; dated Mar. 8, 2021; 23 pages.
DynaEnergetics Europe; Patent Owner's Preliminary Response for PGR No. 2020-00080; dated Nov. 18, 2020; 119 pages.
G&H Diversified Manufacturing LP; Petition for Post Grant Review PGR No. 2021-00078; dated May 10, 2021; 122 pages.
Hunting Titan Gun System Catalog; Exhibit No. 1035 of PGR No. 2021-00078; 59 pages.
Hunting Wireline Hardware Brochures; Exhibit No. 1025 of PGR No. 2021-00078; dated 2013; 27 pages.
International Searching Authority; International Search Report and Written Opinion of the International Searching Authority for PCT/EP2020/086496; dated Apr. 7, 2021; 10 pages.
Isolation Sub Assembly; Exhibit No. 1027 of PGR No. 2021-00078; dated Mar. 2008; 5 pages.
Parrot, Robert A.; Declaration in Support of PGR20201-00089; dated Jun. 1, 2021; 353 pages.
Parrott, Robert; Declaration for PGR No. 2021-00078; dated May 10, 2021; 182 pages.
Perforating Services Catalog 2008 part 1 of 2; Exhibit 1020 of PGR No. 2021-00089 dated 2008; 282 pages.
Perforating Services Catalog 2008 part 2 of 2; Exhibit 1020 of PGR No. 2021-00089; dated 2008; 239 pages.
Schlumberger Technology Corporation; Petiton for Post Grant Review Case No. PGR2021-00089; dated Jun. 1, 2021; 155 pages.
Select Fire System; Exhibit 1028 of PGR 2021-00078; dated 2012; 165 pages.
United States Patent and Trademark Office; Advisory Action Before the Filing of an Appeal Brief for U.S. Appl. No. 16/540,484; dated May 19, 2021; 3 pages.
United States Patent and Trademark Office; Non-Final Office Action for U.S. Appl. No. 17/206,416; dated May 19, 2021; 10 pages.
United States Patent and Trademark Office; Notice of Allowance for U.S. Appl. No. 17/007,574 dated May 21, 2021; 8 pages.

(56) References Cited

OTHER PUBLICATIONS

Nextier Completion Solutions Inc.; Exhibit A-10 U.S. Pat. No. 7,762,331 to Goodman; dated Aug. 30, 2021; 4 pages.
Nextier Completion Solutions Inc.; Exhibit A-11 U.S. Patent Publication No. 2016/0084048 A1 to Harrigan et al.; dated Aug. 30, 2021; 4 pages.
Nextier Completion Solutions Inc.; Exhibit A-12 U.S. Appl. No. 61/819,196 to Harrigan et al.; dated Aug. 30, 2021; 26 pages.
Nextier Completion Solutions Inc.; Exhibit A-13 U.S. Pat. No. 9,874,083 to Logan; dated Aug. 30, 2021; 18 pages.
Nextier Completion Solutions Inc.; Exhibit A-14 New Select-Fire System; dated Aug. 30, 2021; 33 pages.
Nextier Completion Solutions Inc.; Exhibit A-15 U.S. Pat. No. 10,077,641 to Rogman; dated Aug. 30, 2021; 36 pages.
Nextier Completion Solutions Inc.; Exhibit A-16 U.S. Appl. No. 61/733,129 to Rogman; dated Aug. 30, 2021; 55 pages.
Nextier Completion Solutions Inc.; Exhibit A-17 U.S. Pat. No. 8,387,533 to Runkel; dated Aug. 30, 2021; 5 pages.
Nextier Completion Solutions Inc.; Exhibit A-18 Schlumberger SafeJet; dated Aug. 30, 2021; 13 pages.
Nextier Completion Solutions Inc.; Exhibit A-19 U.S. Pat. No. 7,226,303 to Shaikh; dated Aug. 30, 2021; 4 pages.
Nextier Completion Solutions Inc.; Exhibit A-2 U.S. Pat. No. 6,506,083 to Bickford et al.; dated Aug. 30, 2021; 3 pages.
Nextier Completion Solutions Inc.; Exhibit A-20 U.S. Pat. No. 8,943,943 to Carlos Jose Tassaroli; dated Aug. 30, 2021; 7 pages.
Nextier Completion Solutions Inc.; Exhibit A-3 U.S. Patent Pub. No. US 2012/0247771 A1 to Black et al.; dated Aug. 30, 2021; 30 pages.
Nextier Completion Solutions Inc.; Exhibit A-4 U.S. Pat. No. 4,457,383 to Gene T. Boop; dated Aug. 30, 2021; 22 pages.
Nextier Completion Solutions Inc.; Exhibit A-5 U.S. Pat. No. 3,173,229 to Gene T. Boop; dated Aug. 30, 2021; 12 pages.
Nextier Completion Solutions Inc.; Exhibit A-6 U.S. Pat. No. 9,065,201 to Borgfeld et al.; dated Aug. 30, 2021; 3 pages.
Nextier Completion Solutions Inc.; Exhibit A-7 U.S. Pat. No. 6,582,251 to Burke et al.; dated Aug. 30, 2021; 3 pages.
Nextier Completion Solutions Inc.; Exhibit A-8 U.S. Patent Publication No. 2013/0126237 A1 to Burton dated Aug. 30, 2021; 3 pages.
Nextier Completion Solutions Inc.; Exhibit A-9 Selective perforation: A Game Changer in Peforating Technology—Case Study; dated Aug. 30, 2021; 13 pages.
Nextier Completion Solutions; Plaintiffs Preliminary Invalidity Contentions for Civil Action No. 4:21-cv-01328; dated Jun. 30, 2021; 19 pages.
Nexus Perforating LLC; Invalidity Contentions for Civil Action No. 4:21-cv-00280; dated Jun. 30, 2021; 44 pages.
Nexus Perforating LLC; Nexus Preliminary Claim Construction and Extrinsic Evidence for Civil Action No. 4:21-cv-00280; dated Aug. 4, 2021; 6 pages.
Oilfield Glossary; Definition of Perforating Gun; dated Feb. 26, 2013; 2 pages.
oilgasglossary.com; Definition of "sub"; dated Nov. 20, 2008; 1 page.
Olsen, Steve; Declaration regarding the SafeJet System for PGR2021-00097; dated Jul. 16, 2021; 25 pages.
Oso Perforating, LLC; Defendant's Preliminary Invalidity Contentions for Civil Action No. 3:21-cv-00188-M; dated Aug. 4, 2021; 23 pages.
Oso Perforating, LLC; Exhibit A1 U.S. Pat. No. 5,155,293 to Barton vs. Asserted Claims of U.S. Pat. No. 10,844,697; dated Aug. 4, 2021; 21 pages.
Oso Perforating, LLC; Exhibit A10 U.S. Pat. No. 8,869,887 to Deere, et al. vs. Asserted Claims of U.S. Pat. No. 10,844,697; dated Aug. 4, 2021; 10 pages.
Oso Perforating, LLC; Exhibit A11 U.S. Pat. No. 4,457,383 to Boop. vs. Asserted Claims of U.S. Pat. No. 10,844,697; dated Aug. 4, 2021; 22 pages.
Oso Perforating, LLC; Exhibit A12 U.S. Publication No. 2012/0247771 to Black, et al. vs. Asserted Claims of U.S. Pat. No. 10,844,697; dated Aug. 4, 2021; 26 pages.
Oso Perforating, LLC; Exhibit A13 U.S. Publication No. 2016/0084048 to Harrigan, et al. vs. Asserted Claims of U.S. Pat. No. 10,844,697; dated Aug. 4, 2021; 14 pages.
Oso Perforating, LLC; Exhibit A14 U.S. Publication No. 2010/0065302 to Nesbitt vs. Asserted Claims of U.S. Pat. No. 10,844,697; dated Aug. 4, 2021; 15 pages.
Oso Perforating, LLC; Exhibit A15 U.S. Pat. No. 3,173,992 to Boop vs. Asserted Claims of U.S. Pat. No. 10,844,697; dated Aug. 4, 2021; 17 pages.
Oso Perforating, LLC; Exhibit A16 U.S. Pat. No. 6,506,083 to Bickford, et al. vs. Asserted Claims of U.S. Pat. No. 10,844,697; dated Aug. 4, 2021; 17 pages.
Oso Perforating, LLC; Exhibit A17 U.S. Pat. No. 8,387,533 to Runkel vs. Asserted Claims of U.S. Pat. No. 10,844,697; dated Aug. 4, 2021; 16 pages.
Oso Perforating, LLC; Exhibit A18 U.S. Pat. No. 8,943,943 to Tassaroli vs. Asserted Claims of U.S. Pat. No. 10,844,697; dated Aug. 4, 2021; 7 pages.
Oso Perforating, LLC; Exhibit A19 U.S. Pat. No. 7,762,331 to Goodman vs. Asserted Claims of U.S. Pat. No. 10,844,697; dated Aug. 4, 2021; 28 pages.
Oso Perforating, LLC; Exhibit A2 U.S. Pat. No. 6,582,251 to Burke, et al. vs. Asserted Claims of U.S. Pat. No. 10,844,697; dated Aug. 4, 2021; 15 pages.
Oso Perforating, LLC; Exhibit A20 U.S. Publication No. 2012/01999352 to Lanclos vs. Asserted Claims of U.S. Pat. No. 10,844,697; dated Aug. 4, 2021; 24 pages.
Oso Perforating, LLC; Exhibit A21 "3.12-in Frac Gun" Publication and 3.12-in Frac Gun System by Sclumberger vs. Asserted Claims of U.S. Pat. No. 10,844,697; dated Aug. 4, 2021; 26 pages.
Oso Perforating, LLC; Exhibit A22 "New Select-Fire System" Publication and Select-Fire System by BakerHughes vs. Asserted Claims of U.S. Pat. No. 10,844,697; dated Aug. 4, 2021; 14 pages.
Oso Perforating, LLC; Exhibit A23 Amit Govil, "Selective Perforation: A Game Changer in Perforating Technology—Case Study," 2012 European and West African Perforating Symposium ("EWAPS") vs. Asserted Claims of U.S. Pat. No. 10,844,697; dated Aug. 4, 2021; 17 pages.
Oso Perforating, LLC; Exhibit A24 Schlumberger SafeJet System vs. Asserted Claims of U.S. Pat. No. 10,844,697; dated Aug. 4, 2021; 26 pages.
Oso Perforating, LLC; Exhibit A3 U.S. Pat. No. 7,901,247 to Ring vs. Asserted Claims of U.S. Pat. No. 10,844,697; dated Aug. 4, 2021; 19 pages.
Oso Perforating, LLC; Exhibit A4 U.S. Pat. No. 9,145,764 to Burton, et al. vs. Asserted Claims of U.S. Pat. No. 10,844,697; dated Aug. 4, 2021; 18 pages.
Oso Perforating, LLC; Exhibit A5 U.S. Pat. No. 9,175,553 to McCann, et al. vs. Asserted Claims of U.S. Pat. No. 10,844,697; dated Aug. 4, 2021; 26 pages.
Oso Perforating, LLC; Exhibit A6 U.S. Pat. No. 9,689,223 to Schacherer, et al. vs. Asserted Claims of U.S. Pat. No. 10,844,697; dated Aug. 4, 2021; 8 pages.
Oso Perforating, LLC; Exhibit A7 WO 2014/089194 to Rogman, et al vs. Asserted Claims of U.S. Pat. No. 10,844,697; dated Aug. 4, 2021; 16 pages.
Oso Perforating, LLC; Exhibit A8 U.S. Publication No. 2008/0073081 to Frazier, et al. vs. Asserted Claims of U.S. Pat. No. 10,844,697; dated Aug. 4, 2021; 33 pages.
Oso Perforating, LLC; Exhibit A9 U.S. Pat. No. 9,065,201 to Borgfeld, et al. vs. Asserted Claims of U.S. Pat. No. 10,844,697; dated Aug. 4, 2021; 14 pages.
United States District Court for the Western District of Texas; Order Granting in Part & Denying on Part Defendants' Motion to Dismiss for Improper Venue or to Transfer Venue Pursuant to 28 U.S.C. § 1404(a) for Civil Action No. 6:20-CV-01110-ADA; dated Aug. 5, 2021; 16 pages.
United States Patent and Trademark Office; Application Data Sheet for U.S. Appl. No. 14/888,882; dated Nov. 3, 2015; 9 pages.

(56) References Cited

OTHER PUBLICATIONS

United States Patent and Trademark Office; Application Data Sheet for U.S. Appl. No. 61/819,196; dated Jan. 16, 2014; 9 pages.
United States Patent and Trademark Office; Final Office Action for U.S. Appl. No. 17/221,219; dated Aug. 24, 2021; 14 pages.
United States Patent and Trademark Office; Non-Final Office Action for U.S. Appl. No. 17/221,219; dated Jun. 17, 2021; 10 pages.
United States Patent and Trademark Office; Patent Assignment for U.S. Appl. No. 61/733,129; dated Jan. 25, 2013; 2 pages.
United States Patent and Trademark Office; U.S. Appl. No. 61/739,592; dated Dec. 19, 2012; 65 pages.
United States Patent Trial and Appeal Board; Record of Oral Hearing held Feb. 18, 2020 for IPR dated 2018-00600; dated Feb. 18, 2020; 27 pages.
Wetechnologies; Downhole Connectors, High Pressure HP / HT & Medium Pressure MP /MT; dated Apr. 3, 2016; http://wetechnologies.com/products/hp-ht-downhole/; 3 pages.
Wooley, Gary R.; Declaration in Support of Petition for Post Grant Review of U.S. Pat. No. 10,844,697 for PGR2021-00097; dated Jul. 17, 2021; 90 pages.
Yellow Jacket Oil Tools, LLC; Defendant Yellow Jacket Oil Tools, LLC's Answer to Plaintiffs' First Amended Complaint for Civil Action No. 6:20-cv-01110; dated Aug. 10, 2021; 13 pages.
Yellowjacket Oil Tools, LLC and G&H Diversified Manufacturing, LP; Defendants' Preliminaray Invalidity Contentions for Civil Action No. 6:20-cv-01110-ADA; dated May 6, 2021; 20 pages.
Yellowjacket Oil Tools, LLC and G&H Diversified Manufacturing, LP; Defendants' Preliminary Invalidity Contentions for Civil Action No. 6:20-cv-01110-ADA; dated Aug. 30, 2021; 21 pages.
Yellowjacket Oil Tools, LLC and G&H Diversified Manufacturing, LP; Exhibit A-1 BakerHughes Select-Fire; dated Aug. 30, 2021; 33 pages.
Yellowjacket Oil Tools, LLC and G&H Diversified Manufacturing, LP; Exhibit A-10 U.S. Pat. No. 7.762,331 to Goodman; dated Aug. 30, 2021; 4 pages.
Yellowjacket Oil Tools, LLC and G&H Diversified Manufacturing, LP; Exhibit A-11 U.S. Patent Publication No. 2016 0084048 A1 to Harrigan et al.; dated Aug. 30, 2021; 4 pages.
Yellowjacket Oil Tools, LLC and G&H Diversified Manufacturing, LP; Exhibit A-12 U.S. Appl. No. 61/819,196 to Harrigan et al.; dated Aug. 30, 2021; 26 pages.
Yellowjacket Oil Tools, LLC and G&H Diversified Manufacturing, LP; Exhibit A-13 U.S. Pat. No. 9,874,083 to Logan; dated Aug. 30, 2021; 18 pages.
Yellowjacket Oil Tools, LLC and G&H Diversified Manufacturing, LP; Exhibit A-14 New Select-Fire System; dated Aug. 30, 2021; 33 pages.
Yellowjacket Oil Tools, LLC and G&H Diversified Manufacturing, LP; Exhibit A-15 U.S. Pat. No. 10,077,641 to Rogman; dated Aug. 30, 2021; 36 pages.
Yellowjacket Oil Tools, LLC and G&H Diversified Manufacturing, LP; Exhibit A-16 U.S. Appl. No. 61/733,129 to Rogman; dated Aug. 30, 2021; 55 pages.
Yellowjacket Oil Tools, LLC and G&H Diversified Manufacturing, LP; Exhibit A-17 U.S. Pat. No. 8,387,533 to Runkel; dated Aug. 30, 2021; 5 pages.
Yellowjacket Oil Tools, LLC and G&H Diversified Manufacturing, LP; Exhibit A-18 Schlumberger SafeJet; dated Aug. 30, 2021; 13 pages.
Yellowjacket Oil Tools, LLC and G&H Diversified Manufacturing, LP; Exhibit A-19 U.S. Pat. No. 7,226,303 to Shaikh; dated Aug. 30, 2021; 4 pages.
Yellowjacket Oil Tools, LLC and G&H Diversified Manufacturing, LP; Exhibit A-2 U.S. Pat. No. 6,506,083 to Bickford et al.; dated Aug. 30, 2021; 3 pages.
Yellowjacket Oil Tools, LLC and G&H Diversified Manufacturing, LP; Exhibit A-20 U.S. Pat. No. 8,943,943 to Carlos Jose Tassaroli; dated Aug. 30, 2021; 7 pages.
Yellowjacket Oil Tools, LLC and G&H Diversified Manufacturing, LP; Exhibit A-3 U.S. Patent Pub. No. US 2012/0247771 A1 to Black et al.; dated Aug. 30, 2021; 30 pages.
Yellowjacket Oil Tools, LLC and G&H Diversified Manufacturing, LP; Exhibit A-4 U.S. Pat. No. 4,457,383 to Gene T. Boop; dated Aug. 30, 2021; 22 pages.
Yellowjacket Oil Tools, LLC and G&H Diversified Manufacturing, LP; Exhibit A-5 U.S. Pat. No. 3,173,229 to Gene T. Boop; dated Aug. 30, 2021; 12 pages.
Yellowjacket Oil Tools, LLC and G&H Diversified Manufacturing, LP; Exhibit A-6 U.S. Pat. No. 9,065,201 to Borgfeld et al.; dated Aug. 30, 2021; 3 pages.
Yellowjacket Oil Tools, LLC and G&H Diversified Manufacturing, LP; Exhibit A-7 U.S. Pat. No. 6,582,251 to Burke et al.; dated Aug. 30, 2021; 3 pages.
Yellowjacket Oil Tools, LLC and G&H Diversified Manufacturing, LP; Exhibit A-8 U.S. Patent Publication No. 2013/0126237 A1 to Burton; dated Aug. 30, 2021; 3 pages.
Yellowjacket Oil Tools, LLC and G&H Diversified Manufacturing, LP; Exhibit A-9 Selective perforation: A Game Changer in Peforating Technology—Case Study; dated Aug. 30, 2021; 13 pages.
PerfX Wireline Services, LLC; PerfX Wireline Services, LLC's Preliminary Invalidity Contentions for Civil Action Mo 1:20-CV-03665; dated Jul. 2, 2021; 4 pages.
PerfX Wireline Services, LLC; Invalidity Chart for U.S. Pat. No. 10,844,697 in view of the Dynawell Gun System Exhibit A; dated Jul. 2, 2021; 42 pages.
PerfX Wireline Services, LLC; Invalidity Chart for U.S. Pat. No. 10,844,697 in view of the LRI Gun System Exhibit B; dated Jul. 2, 2021; 33 pages.
PerfX Wireline Services, LLC; Invalidity Chart for U.S. Pat. No. 10,844,697 in view of the Owen Oil Tools System Exhibit C; dated Jul. 2, 2021; 64 pages.
PerfX Wireline Services, LLC; Invalidity Chart for U.S. Pat. No. 10,844,697 in view of the Select Fire System Exhibit D; dated Jul. 2, 2021; 49 pages.
PerfX Wireline Services, LLC; Invalidity Chart for U.S. Pat. No. 10,844,697 in view of U.S. Pat. No. 10,077,641 Exhibit H; dated Jul. 2, 2021; 41 pages.
PerfX Wireline Services, LLC; Invalidity Chart for U.S. Pat. No. 10,844,697 in view of U.S. Pat. No. 4,007,796 Exhibit F; dated Jul. 2, 2021; 40 pages.
PerfX Wireline Services, LLC; Invalidity Chart for U.S. Pat. No. 10,844,697 in view of U.S. Pat. No. 5,042,594 Exhibit E; dated Jul. 2, 2021; 38 pages.
PerfX Wireline Services, LLC; Invalidity Chart for U.S. Pat. No. 10,844,697 in view of U.S. Pat. No. 9,145,764 Exhibit G; dated Jul. 2, 2021; 58 pages.
PerfX's Wireline Services, LLC; Exhibit A-1: Invalidity Chart for U.S. Pat. No. 10,844,697 in view of the Dynawell Gun System; dated Aug. 30, 2021; 30 pages.
PerfX's Wireline Services, LLC; Exhibit A-2: Invalidity Chart for U.S. Pat. No. 10,844,697 in view of the LRI Gun System; dated Aug. 30, 2021; 29 pages.
PerfX's Wireline Services, LLC; Exhibit A-3: Invalidity Chart for U.S. Pat. No. 10,844,697 in view of the Owen Oil Tools System; dated Aug. 30, 2021; 42 pages.
PerfX's Wireline Services, LLC; Exhibit A-4: Invalidity Chart for U.S. Pat. No. 10,844,697 in view of the Select Fire System; dated Aug. 30, 2021; 32 pages.
PerfX's Wireline Services, LLC; Exhibit A-5: Invalidity Chart for U.S. Pat. No. 10,844,697 in view of U.S. Pat. No. 5,042,594; dated Aug. 30, 2021; 27 pages.
PerfX's Wireline Services, LLC; Exhibit A-6: Invalidity Chart for U.S. Pat. No. 10,844,697 in view of U.S. Pat. No. 4,007,796; dated Aug. 30, 2021; 23 pages.
PerfX's Wireline Services, LLC; Exhibit A-7: Invalidity Chart for U.S. Pat. No. 10,844,697 in view of U.S. Pat. No. 9,145,764; dated Aug. 30, 2021; 36 pages.
Perfx's Wireline Services, LLC; Exhibit A-8: Invalidity Chart for U.S. Pat. No. 10,844,697 in view of U.S. Pat. No. 10,077,6414; dated Aug. 30, 2021; 29 pages.

(56) References Cited

OTHER PUBLICATIONS

PerfX's Wireline Services, LLC; Exhibit A-9: Invalidity Chart for U.S. Pat. No. 10,844,697 in view of the SafeJet System; dated Aug. 30, 2021; 18 pages.
PerfX's Wireline Services, LLC; Exhibit B-1: Invalidity Chart for U.S. Pat. No. D. 904,475 in view of the Dynawell Tandem Sub; dated Aug. 30, 2021; 10 pages.
PerfX's Wireline Services, LLC; Exhibit B-2: Invalidity Chart for U.S. Pat. No. D. 904,475 in view of the LRI Tandem Subassembly; dated Aug. 30, 2021; 12 pages.
PerfX's Wireline Services, LLC; Exhibit B-3: Invalidity Chart for U.S. Pat. No. D. 904,475 in view of the Owen Oil Tools Tandem Sub; dated Aug. 30, 2021; 10 pages.
PerfX's Wireline Services, LLC; Exhibit B4: Invalidity Chart for U.S. Pat. No. D. 904,475 in view of the XConnect Tandem Sub; dated Aug. 30, 2021; 1 page.
Perfx's Wireline Services, LLC; Exhibit B-5: Invalidity Chart for U.S. Pat. No. D. 904,475 in view of the SafeJet Disposable Bulkhead; dated Aug. 30, 2021; 15 pages.
PerfX's Wireline Services, LLC; Exhibit B-6: Invalidity Chart for U.S. Pat. No. D. 904,475 in view of Chinese Patent Application No. CN110424930A; dated Aug. 30, 2021; 9 pages.
PerfX's Wireline Services, LLC; Exhibit B-7: Invalidity Chart for U.S. Pat. No. D. 904,475 in view of U.S. Patent Publication No. 2020/0308938; dated Aug. 30, 2021; 8 pages.
PerfX's Wireline Services, LLC; Xconnect, LLC's Preliminary Invalidity Contentions for Civil Action No. 6:21-cv-00371-ADA; dated Aug. 30, 2021; 7 pages.
Rodgers, John; Declaration for Civil Action No. 3:20-CV-00376; dated Jul. 8, 2021; 32 pages.
Rodgers, John; Declaration for Civil Action No. 3:21-cv-00192-M; dated May 27, 2021; 42 pages.
Rodgers, John; Declaration for PGR2021-00078; dated Aug. 19, 2021; 137 pages.
Salt, et al.; New Perforating Gun System Increases Saftey and Efficiency; Journal of Petroleum Technology; dated Apr. 1, 2016; Weatherford; https://jpt.spe.org/new-perforating-gun-system-increases-safety-and-efficiency; 11 pages.
Schlumberger; 3.12-in Frac Gun; dated 2007; 2 pages.
Schlumberger; Field Test Database Print Out Showing uses of the SafeJet System; dated May 11, 2015; 10 pages.
Science Direct; Perforating Gun Well-Bore Construction (Drilling and Completions); dated Jul. 20, 2021; 13 pages.
SWM International, LLC and Nextier Oil Completion Solutions, LLC; Petition for Post Grant Review PGR No. 2021-00097; dated Jul. 20, 2021; 153 pages.
SWM International, LLC; Defendant's P.R. 3-3 and 3-4 Preliminary Invalidity Contentions; dated Aug. 4, 2021 28 pages.
SWM International, LLC; Defendant's P.R. 4-1 Disclosure of Proposed Terms and Claim Elements for Construction for Civil Action No. 3:21-cv-00192-M; dated Aug. 24, 2021; 5 pages.
SWM International, LLC; Ex. A-1 Invalidity of U.S. Pat. No. 10,844,697 Over the SafeJet System; dated Aug. 4, 2021; 15 pages.
SWM International, LLC; Ex. A-1A Invalidity of U.S. Pat. No. 10,844,697 Over the SafeJet System in view of Backhus; dated Aug. 4, 2021; 4 pages.
SWM International, LLC; Ex. A-1B Invalidity of U.S. Pat. No. 10,844,697 Over the SafeJet System in view of Harrigan; dated Aug. 4, 2021; 3 pages.
SWM International, LLC; Ex. A-2 Invalidity of U.S. Pat. No. 10,844,697 Over Goodman; dated Aug. 4, 2021; 11 pages.
SWM International, LLC; Ex. A-2A Invalidity of U.S. Pat. No. 10,844,697 Over Goodman in view of Backhus; dated Aug. 4, 2021; 3 pages.
SWM International, LLC; Ex. A-2B Invalidity of U.S. Pat. No. 10,844,697 Over Goodman in view of Harrigan; dated Aug. 4, 2021; 3 pages.
SWM International, LLC; Ex. A-3 Invalidity of U.S. Pat. No. 10,844,697 Over Harrigan; dated Aug. 4, 2021; 13 pages.
SWM International, LLC; Ex. A-4 Invalidity of U.S. Pat. No. 10,844,697 Over Burton; dated Aug. 4, 2021; 11 pages.
SWM International, LLC; Ex. A-5 Invalidity of U.S. Pat. No. 10,844,697 Over Rogman; dated Aug. 4, 2021; 10 pages.
SWM International; Drawing of SafeJet System; dated Jul. 20, 2021; 1 page.
SWM International; Photographs of SafeJet System; dated Jul. 20, 2021; 9 pages.
Tolteq; iSeries MWD System; dated 2021; 9 pages.
United States District Court for the Southern District of Texas; Joint Claim Construction Statement for Civil Action No. 3:20-cv-00376; dated Jul. 8, 2021; 14 pages.
United States District Court for the Southern District of Texas; Joint Claim Construction Statement for Civil Action No. 4:20-cv-02123; dated Aug. 27, 2021; 14 pages.
Canadian Intellectual Property Office; Office Action for CA Application No. 3,070,118; dated Nov. 17, 2021; 3 pages.
Patent Trial and Appeals Board; Decision Granting Institution of Post Grant Review, PGR No. PGR2021-00097; dated Jan. 6, 2022; 92 pages.
Schlumberg; Lina Pradilla, Wireline Efficiency in Unconventional Plays—The Argentinean Experience, including excerpted image from slide 13; dated 2013; 16 pages http://www.perforators.org/wp-content/uploads/2015/10/SLAP_47_Wireline_Efficiency_Unconventional_Plays.pdf.
SWM International, LLC and Nextier Completion Solutions LLC; Petitioner'S Preliminary Reply To Patent Owner'S Preliminary Response for Case No. PGR2021-00097; dated Nov. 15, 2021; 11 pages.
United States Patent and Trademark Office; Notice of Allowance for U.S. Appl. No. 17/221,219; dated Jan. 13, 2022; 11 pages.
Brinsden, Mark; Declaration of Mark Brinsden; dated Sep. 30, 2021; 51 pages.
DynaEnergetics Europe GMBH, Oso Perforating, LLC, SWM International, LLC and Bear Manufacturing, LLC; Joint Claim Construction Statement for Northern District of Texas Civil Action Nos. 3:21-cv-00188, 3:21-cv-00192 and 3:21-cv-00185; dated Sep. 28, 2021; 29 pages.
DynaEnergetics Europe GMBH; Reply Under 37 C.F.R. §1.111 Amendment Under 37 C.F.R. §1.121 for U.S. Appl. No. 16/585,790; dated Feb. 20, 2020; 18 pages.
DynaEnergetics Europe, GMBH; Patent Owner's Preliminary Response for PGR No. 2021-00097; dated Oct. 29, 2021; 110 pages.
DynaEnergetics, No Debris Gun System (NDG), Hamburg, Germany, Feb. 6, 2008, 26 pgs.
Fayard, Alfredo; Declaration of Alfredo Fayard; dated Oct. 18, 2021; 13 pages.
G&H Diversified Manufacturing, LP; Defendant G&H Diversified Manufacturing, LP's Opening Claim Construction Brief; dated Oct. 18, 2021; 25 pages.
GR Energy Services Operating GP LLC, GR Energy Services Management, LP and GR Energy Services, LLC; GR Energy's Opening Claim Construction Brief; dated Oct. 18, 2021; 23 pages.
Horizontal Wireline Services, LLC and Allied Wireline Services, LLC; Defendants' Opening Claim Construction Brief; dated Oct. 18, 2021; 27 pages.
Hunting Titan, Inc.; Defendant's Responsive Claim Construction Brief for Civil Action No. 4:20-cv-02123; dated Oct. 1, 2021; 31 pages.
Hunting Titan, Inc.; Defendant's Supplemental Brief on Claim Construction; dated Nov. 5, 2021; 9 pages.
Hunting Titan, Wireline Hardware, Logging Instruments EBFire, TCB Systems, Gun Systems, Oct. 15, 2015, V.9.1, 72 pgs., http://www.hunting-intl.com/media/1305595/hunting-titan-complete-v9-1.pdf.
International Searching Authority; International Search Report and Written Opinion for International Application No. PCT/US19/15255; dated Apr. 23, 2019; 12 pages.
International Searching Authority; International Search Report and Written Opinion for International Application No. PCT/US2020/032879; dated Aug. 20, 2020; 9 pages.

(56) References Cited

OTHER PUBLICATIONS

Lehr, Doug; Declaration of Doug Lehr in Supprt of Repeat Precision's Response Claim Construction Brief; dated Oct. 27, 2021; 35 pages.
Meehan, Nathan; Declaration of D. Nathan Meehan, Ph.D, P.E; dated Oct. 18, 2021; 86 pages.
Nextier Completion Solutions Inc.; Defendant NexTier Completion Solution Inc.'s Opening Claim Construction Brief; dated Oct. 18, 2021; 26 pages.
Nexus Perforating LLC; Nexus Perforating LLC's Responsive Claim Construction Brief for Civil Action No. 4:21-ov-00280; dated Nov. 5, 2021; 31 pages.
Norwegian Industrial Property Office; Office Action for NO Application No. 20210799; dated Oct. 30, 2021; 2 pages.
PerfX Wireline Services, LLC; Defendant PerfX Wireline Services, LLC's Opening Claim Construction Brief; dated Oct. 18, 2021; 23 pages.
Repeat Precision, LLC; Plaintiff Repeat Precision, LLC's Responsive Claim Construction Brief for Civil Action No. 5:21-cv-104-ADA, Public Version; dated Oct. 27, 2021; 21 pages.
Rodgers, John; Claim Construction Declaration for Civil Action No. 3:21-cv-00185; dated Sep. 28, 2021; 41 pages.
Rodgers, John; Claim Construction Declaration for Civil Action No. 3:21-cv-00188; dated Sep. 28, 2021; 42 pages.
Rodgers, John; Declaration of John Rodgers, Ph.D for PGR Case No. PGR2021-00097; dated Oct. 28, 2021 124 pages.
Rodgers, John; Videotaped Deposition of John Rodgers; dated Jul. 29, 2021; 49 pages.
Schlumberger Technology Corporation, Defendant Schlumberger Technology Corporation's Opening Claim Construction Brief for Civil Action No. 6:21-cv-00225-ADA; dated Oct. 6, 2021; 27pages.
Schlumberger Technology Corporation; Defendant Schlumberger Technology Corporation'S Reply To Plaintiffs' Responsive Claim Construction Brief; dated Nov. 10, 2021; 17 pages.
Schlumberger Technology Corporation; Petitioner's Reply to Patent Owner's Preliminary Response; dated Oct. 13, 2021; 14 pages.
Shelby Sullivan; Declaration of Shelby Sullivan; dated Oct. 18, 2021; 9 pages.
United States Patent and Trademark Office; Decision Granting Institution of Post-Grant Review 35 U.S.C. § 324 for PGR2021-00078; dated Nov. 1, 2021; 87 pages.
United States Patent and Trademark Office; Information Disclosure Statement for U.S. Appl. No. 16/293,508; dated Dec. 10, 2020; 7 pages.
United States Patent and Trademark Office; Non-Final Office Action for U.S. Appl. No. 17/352,728; dated Oct. 25, 2021; 9 pages.
United States Patent and Trademark Office; Notice of Allowance for U.S. Appl. No. 17/004,966; dated Nov. 8, 2021; 12 pages.
United States Patent and Trademark Office; Notices of Allowabilty for U.S. Appl. No. 16/585,790; dated Jul. 31, 2020 and Mar. 18, 2020; Response to Office Action for U.S. Appl. No. 16/585,790; dated Nov. 12, 2019; 26 pages.
United States Patent and Trademark Office; Office Action and Response to Office Action for U.S. Appl. No. 16/585,790; dated Nov. 12, 2019 and Feb. 12, 2020; 21 pages.
United States Patent and Trademark Office; Order Granting Request for Ex Parte Reexamination; dated Nov. 1, 2021; 14 pages.
Williams, John; Declaration of Dr. John Williams; dated Oct. 18, 2021; 9 pages.
Wooley, Gary R; Declaration of Gary R. Wooley, PHD. Regarding Claim Construction for Civil Action No. 6:21-cv-00225-ADA; dated Oct. 6, 2021; 67 pages.
Wooley, Gary; Declaration of Gary E. Wooley for Civil Action Nos. 6:20-cv-01110-ADA and 6:20-CV-01201-ADA; dated Oct. 18, 2021; 12 pages.
Wooley, Gary; Declaration of Gary R. Wooley for Civil Action No. 3:20-cv-00376; dated Jul. 8, 2021; 11 pages.
Wooley, Gary; Declaration of Gary R. Wooley for Civil Action No. 3:21-cv-00192-M; dated Aug. 17, 2021; 18 pages.
Wooley, Gary; Rebuttal Declaration of Gary R. Wooley, Ph.D. Regarding Claim Construction; dated Nov. 10, 2021; 34 pages.
Wooley, Gary; Transcript of Gary Wooley for Civil Action No. 3:21-cv-00192-M; dated Sep. 2, 2021; 26 pages.
Hunting Titan, Inc.; Defendant Hunting Titan, Inc.'s Opposition to Plaintiffs Motion for Summary Judgement for Civil Action No. 4:20-cv-02123; dated Mar. 30, 2022; 37 pages.
Hunting Titan, Inc.; Defendant Hunting Titan, Inc's Opposed Motion for Leave to Amend Invalidity Contentions for Civil Action No. 4:20-cv-02123; dated Nov. 19, 2021; 17 pages.
Hunting Titan, Inc.; Defendant's Final Invalidity Contentions for Civil Action No. 4:20-cv-02123; dated Jan. 7, 2022; 54 pages.
Hunting Titan, Inc.; Defendant's Preliminary Invalidity Contentions for Civil Action No. 4:20-cv-02123; dated Aug. 6, 2021; 52 pages.
Hunting Titan, Inc.; Exhibit 1 to Defendant Hunting Titan, Inc.'s Opposed Motion for Leave to Amend Invalidity Contentions for Civil Action No. 4:20-cv-02123; dated Nov. 19, 2021; 64 pages.
Hunting Titan, Inc.; Exhibit 2 to Defendant Hunting Titan, Inc.'s Opposed Motion for Leave to Amend Invalidity Contentions for Civil Action No. 4:20-cv-02123; dated Nov. 19, 2021; 33 pages.
Hunting Titan, Inc.; Exhibit 3 to Defendant Hunting Titan, Inc.'s Opposed Motion for Leave to Amend Invalidity Contentions for Civil Action No. 4:20-cv-02123; dated Nov. 19, 2021; 24 pages.
Hunting Titan, Inc.; Exhibit 4 to Defendant Hunting Titan, Inc.'s Opposed Motion for Leave to Amend Invalidity Contentions for Civil Action No. 4:20-cv-02123; dated Nov. 19, 2021; 9 pages.
Hunting Titan, Inc.; Exhibit 5 to Defendant Hunting Titan, Inc.'s Opposed Motion for Leave to Amend Invalidity Contentions for Civil Action No. 4:20-cv-02123; dated Nov. 19, 2021; 5 pages.
Hunting Titan, Inc.; Exhibit 6 to Defendant Hunting Titan, Inc.'s Opposed Motion for Leave to Amend Invalidity Contentions for Civil Action No. 4:20-cv-02123; dated Nov. 19, 2021; 4 pages.
Hunting Titan, Inc.; Exhibit 7 to Defendant Hunting Titan, Inc.'s Opposed Motion for Leave to Amend Invalidity Contentions for Civil Action No. 4:20-cv-02123; dated Nov. 19, 2021; 6 pages.
Hunting Titan, Inc.; Exhibit A to Defendant's Final Invalidity Contentions, Invalidity of U.S. Pat. No. 10,429,161; dated Jan. 7, 2022; 93 pages.
Hunting Titan, Inc.; Exhibit A to Defendant's Preliminary Invalidity Contentions, Invalidity of U.S. Pat. No. 10,429,161; dated Aug. 6, 2021; 93 pages.
Hunting Titan, Inc.; Exhibit B to Defendant's Final Invalidity Contentions, Invalidity of U.S. Pat. No. 10,472,938; dated Jan. 7, 2022; 165 pages.
Hunting Titan, Inc.; Exhibit B to Defendant's Preliminary Invalidity Contentions, Invalidity of U.S. Pat. No. 10,472,938; dated Aug. 6, 2021; 165 pages.
Hunting Titan, Inc.; Exhibit C to Defendant's Final Invalidity Contentions, Invalidity of U.S. Pat. No. 10,429,161; dated Jan. 7, 2022; 3 pages.
Hunting Titan, Inc.; Exhibit D to Defendant's Final Invalidity Contentions, Invalidity of U.S. Pat. No. 10,472,938; dated Jan. 7, 2022; 6 pages.
United States Patent and Trademark Office; Final Office Action for U.S. Appl. No. 16/540,484; dated Apr. 27, 2022; 12 pages.
United States Patent and Trademark Office; Non-Final Office Action for U.S. Appl. No. 17/007,574; dated May 6, 2022; 10 pages.
United States District Court for the Northern District of Texas Dallas Division; Memorandum Opinion and Order in Civil Action No. 3:21-cv-00192-M; Mar. 23, 2022; 34 pages (order is redacted to protect confidential information; redacted order has not yet been filed by the Court).
United States District Court for the Northern District of Texas Dallas Division; Memorandum Opinion and Order in Civil Action No. 3:21-cv-00188-M; Mar. 23, 2022; 35 pages (order is redacted to protect confidential information; redacted order has not yet been filed by the Court).
G&H Diversified Manufacturing, LP; Petitioner's Oral Argument Presentation for PGR No. PGR2021-00078; dated Jul. 26, 2022; 65 pages.
SWM International, LLC and Nextier Completion Solutions Inc; Petitioner'S Reply to Patent Owner's Response to Petition for Case No. PGR2021-00097; dated Jul. 29, 2022; 36 pages.

(56) References Cited

OTHER PUBLICATIONS

United States Patent and Trademark Office; Non-Final Office Action for U.S. Appl. No. 17/221,219; dated Aug. 3, 2022; 8 pages.
United States Patent and Trademark Office; Final Office Action for U.S. Appl. No. 17/352,728; dated Mar. 9, 2022; 9 pages.
United States Patent and Trademark Office; Non-Final Office Action for U.S. Appl. No. 17/123,972; dated Mar. 3, 2022; 9 pages.
United States Patent and Trademark Office; Non-Final Office Action for U.S. Appl. No. 17/162,579; dated Feb. 28, 2022; 16 pages.
United States Patent and Trademark Office; Non-Final Office Action for U.S. Appl. No. 17/383,816; dated Jan. 25, 2022; 23 pages.
United States Patent and Trademark Office; Office Action in Ex Parte Reexamination for U.S. Pat. No. 10,844,697; dated Jan. 26, 2022; 10 pages.
United States Patent and Trademark Office; Ex Parte Quayle Action for U.S. Appl. No. 17/352,728; dated Jun. 20, 2022; 6 pages.
United States Patent and Trademark Office; Non-Final Office Action for U.S. Appl. No. 17/181,280; dated Apr. 19, 2021; 18 pages.
Bear Manufacturing; Defendant Bear Manufacturing, LLC's Answer, Affirmative Defenses and Counterclaim in response to Plaintiffs' Complaint for Civil Action No. 3:21-cv-00185-M; dated Mar. 22, 2021; 14 pages.
Buche & Associates, P.C.; Rule 501 Citation of Prior Art and Written "Claim Scope Statements" in U.S. Pat. No. 10,844,697; dated Mar. 3, 2021; 24 pages.
United States Patent and Trademark Office; Final Office Action for U.S. Appl. No. 16/540,484; dated Feb. 19, 2021; 12 pages.
United States Patent and Trademark Office; Final Office Action for U.S. Appl. No. 17/004,966; dated Mar. 12, 2021; 18 pages.
United States Patent and Trademark Office; Non-Final Office Action for U.S. Appl. No. 15/920,812; dated Feb. 3, 2021; 7 pages.
United States Patent and Trademark Office; Non-Final Office Action for U.S. Appl. No. 16/819,270; dated Feb. 10, 2021; 13 pages.
United States Patent and Trademark Office; Non-Final Office Action for U.S. Appl. No. 17/007,574; dated Jan. 29, 2021; 11 pages.
United States Patent and Trademark Office; Notice of Allowance for U.S. Appl. No. 16/860,269; dated Apr. 7, 2021; 9 pages.
United States Patent Trial and Appeal Board; Decision Denying Institution of Post-Grant Review; PGR No. 2020-00072; dated Jan. 19, 2021; 38 pages.
United States Patent Trial and Appeal Board; Institution Decision for PGR 2020-00080; dated Feb. 12, 2021; 15 pages.
United States Patent and Trial Appeal Board; Final Written Decision on PGR2021-00078; dated Oct. 28, 2022; 139 pages.
NPI Argentian; Office Action for Application No. 20190101834; dated Aug. 22, 2022; 3 pages.
NPI Argentian; Office Action for Application No. 20190101835; dated Aug. 29, 2023; 3 pages.
Norwegian Industrial Property Office; Office Action for NO Application No. 20180507; dated Sep. 29, 2022; 2 pages.
United States District Court for the Southern District of Texas; Memorandum Opinion and Order for Civil Action No. H-20-2123; dated Sep. 198, 2022; 115 pages.

* cited by examiner

FIG. 4
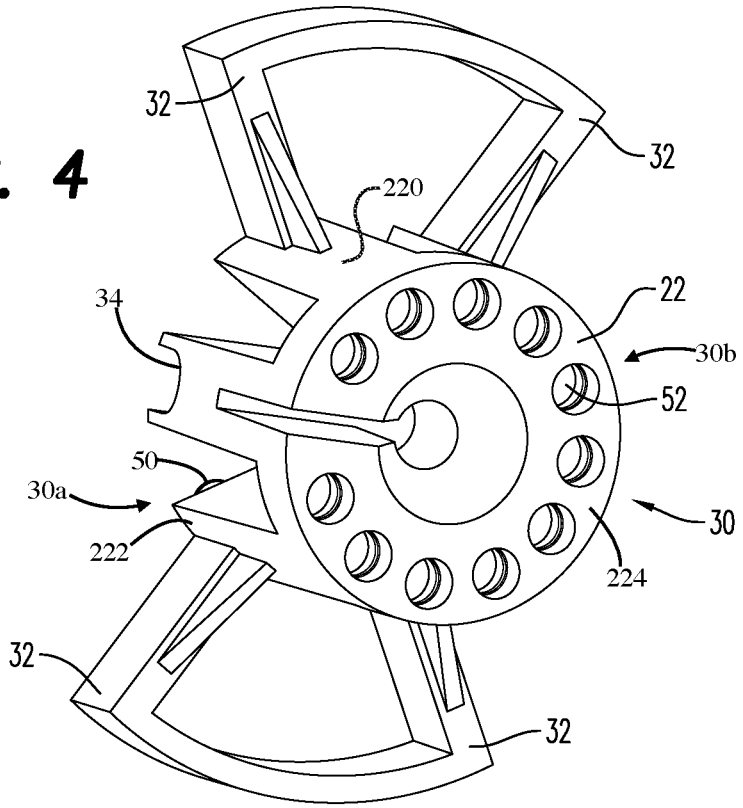
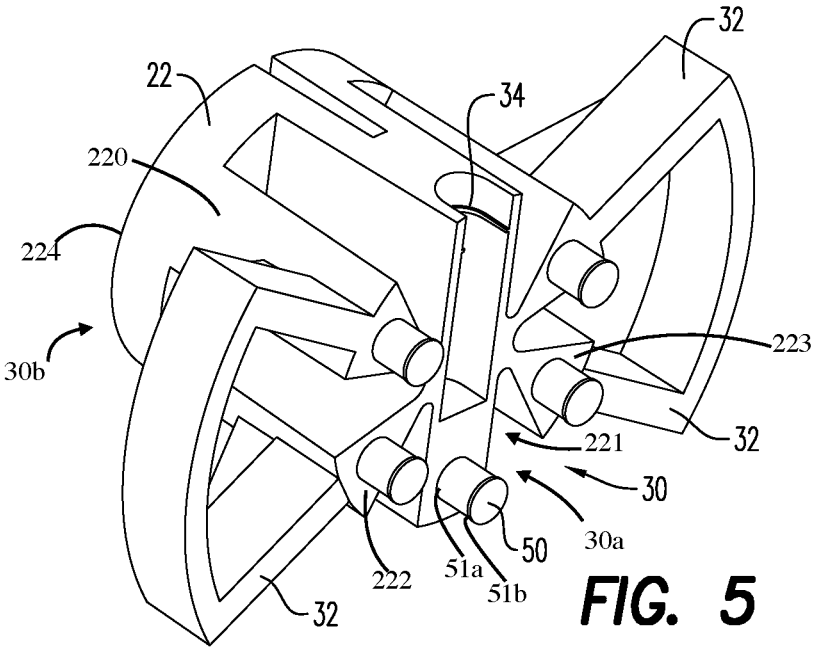
FIG. 5

FIG. 29
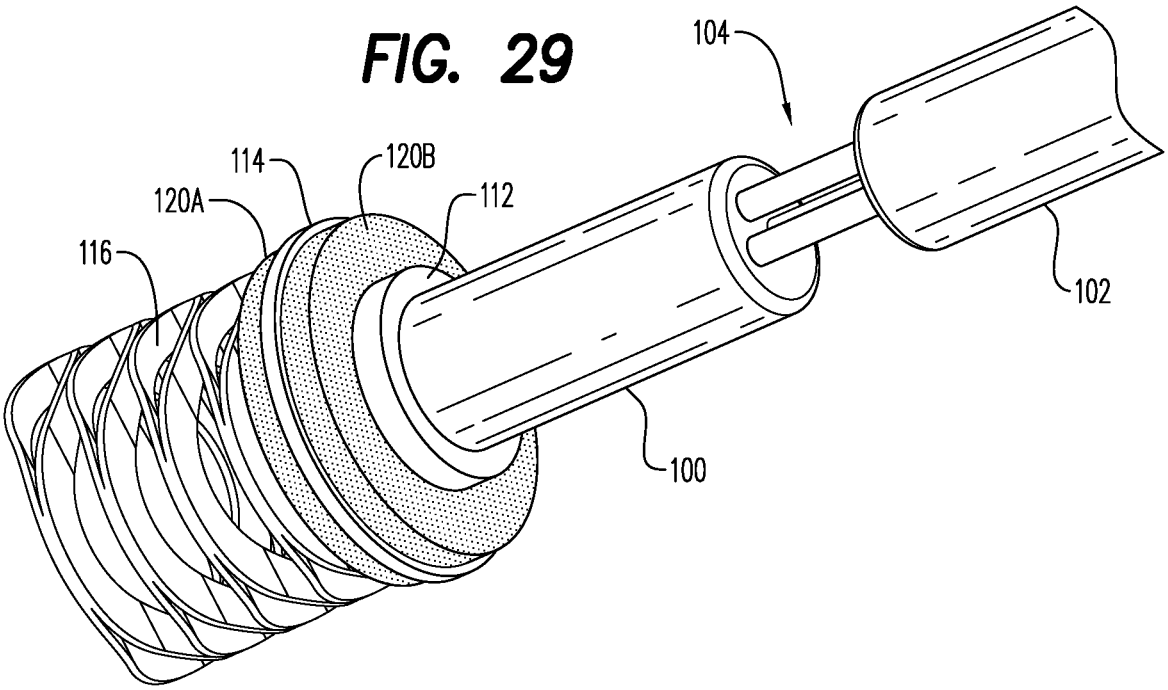
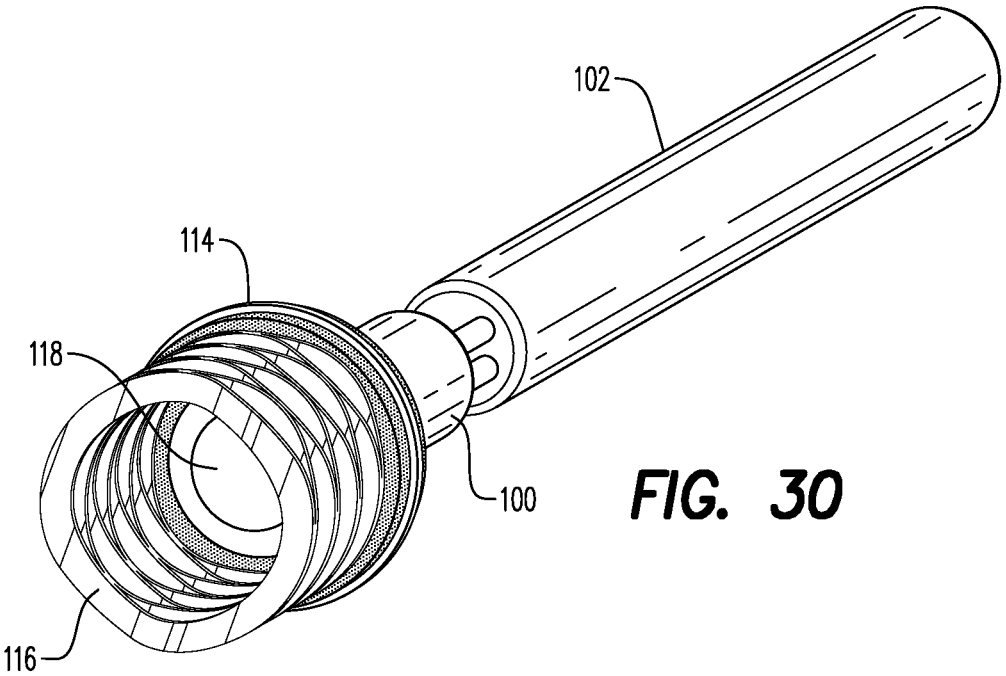
FIG. 30

PERFORATING GUN SYSTEM WITH ELECTRICAL CONNECTION ASSEMBLIES

CROSS-REFERENCE TO RELATED APPLICATIONS

This application is continuation of U.S. patent application Ser. No. 16/585,790 filed Sep. 27, 2019, which is a continuation of U.S. patent application Ser. No. 16/359,540 filed Mar. 20, 2019, now U.S. Pat. No. 10,472,938, which is a continuation of U.S. patent application Ser. No. 15/920,812 filed Mar. 14, 2018, which is a continuation of U.S. patent application Ser. No. 15/617,344 filed Jun. 8, 2017, now U.S. Pat. No. 10,429,161, which is a divisional patent application of U.S. patent application Ser. No. 15/287,309 filed Oct. 6, 2016, now U.S. Pat. No. 9,702,680, which is a divisional patent application of U.S. patent application Ser. No. 14/904,788 filed Jan. 13, 2016, now U.S. Pat. No. 9,494,021, which claims priority to PCT Application No. PCT/CA2014/050673 filed Jul. 16, 2014, which claims priority to Canadian Patent Application No. 2,821,506 filed Jul. 18, 2013, each of which is incorporated herein by reference in its entirety.

FIELD

A perforation gun system is generally described. More particularly, various perforation gun components that can be modularly assembled into a perforation gun system, the assembled perforated gun system itself, a perforation gun system kit, and a method for assembling a perforation gun system are generally described.

BACKGROUND

Perforation gun systems are used in well bore perforating in the oil and natural gas industries to tie a bore hole with a storage horizon within which a storage reservoir of oil or natural gas is located.

A typical perforation gun system consists of an outer gun carrier, arranged in the interior of which there are perforators—usually hollow or projectile charges—that shoot radially outwards through the gun carrier after detonation. Penetration holes remain in the gun carrier after the shot.

In order to initiate the perforators, there is a detonating cord leading through the gun carrier that is coupled to a detonator.

Different perforating scenarios often require different phasing and density of charges or gun lengths. Moreover, it is sometimes desirable that the perforators shooting radially outwards from the gun carrier be oriented in different directions along the length of the barrel. Therefore, phasing may be required between different guns along the length.

Onsite assembly of perforation gun systems may also be problematic under certain conditions as there are certain safety hazards inherent to the assembly of perforation guns due to the explosive nature of certain of its sub-components, including the detonator and the detonating cord.

There is thus a need for a perforation gun system, which by virtue of its design and components would be able to address at least one of the above-mentioned needs, or overcome or at least minimize at least one of the above-mentioned drawbacks.

SUMMARY

According to an embodiment, an object is to provide a perforation gun system that addresses at least one of the above-mentioned needs.

According to an embodiment, there is provided a perforation gun system having an outer gun carrier and comprising:

a top connector;

at least one stackable charge holder for centralizing a single shaped charge within the gun carrier;

a detonation cord connected to the top connector and to each stackable charge holder;

at least one bottom connector for terminating the detonation cord in the gun system; and a detonator energetically coupled to the detonation cord, wherein each of the top connector, at least one stackable charge holder and at least one bottom connector comprise a rotation coupling for providing a selectable clocking rotation between each of the top connector, at least one stackable charge holder and at least one bottom connector.

In some embodiments, the bottom connector may double as a spacer for spacing a plurality of stackable charge holders, and may either act as a metric dimensioned spacer or as an imperial dimensioned spacer for any specific metric or imperial shot density, phase and length gun system.

According to another aspect, there is also provided a perforation gun system kit having component parts capable of being assembled within an outer gun carrier, the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector.

According to another aspect, there is also provided a method for assembling a perforation gun system, comprising the steps of:

providing a perforation gun system kit having component parts capable of being assembled within an outer gun carrier, the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system and adapted for doubling as a spacer for spacing a plurality of stackable charge holders; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector;

assembling a plurality of the stackable charge holders in a predetermined phase to form a first gun assembly;

running the detonation cord into a bottommost bottom connector;

assembling the bottommost bottom connector onto the assembled plurality of stackable charge holders;

running a through wire between the bottommost bottom connector and the top connector, so that the wire goes from the top connector to the bottom connector;

clicking the detonation cord into recesses formed in capturing projections, the captured projections being provided in each of the charge holders;

running the detonation cord into the top connector;

cutting the detonator cord; and installing charges into each of the charge holders.

A number of optional steps that are detailed below may be added to the above-described steps of the method.

According to another aspect, there is also provided a top connector for a perforation gun system comprising:

a coupler for providing energetic coupling between a detonator and a detonating cord;

at least one directional locking fin for locking the top connector within a gun carrier;

a rotation coupling for providing a selectable clocking rotation between the top connector, and a charge holder wherein the top connector is configured to receive electrical connections therethrough.

According to another aspect, there is also provided a stackable charge holder for a perforation gun system having an outer gun carrier, the charge holder comprising:

a charge receiving structure for receiving a single shaped charge;

a plurality of projections for centralizing the shaped charge within the gun carrier; and at least one rotation coupling for providing a selectable clocking rotation between the charge holder and an adjacent component in the perforation gun system;

wherein a pair of the plurality of projections is configured for capturing a detonation cord traversing the charge holder.

According to another aspect, there is also provided a bottom connector for a perforation gun system comprising:

a terminating structure arranged for terminating a detonation cord in the gun system;

a plurality of wings or fins for axially locking the bottom connector to a snap ring fixed in the carrier.

a rotation coupling for providing a selectable clocking rotation between the bottom connector and a charge holder; wherein the rotation coupling is arranged such that bottom connector doubles as a spacer for spacing a plurality of stackable charge holders.

BRIEF DESCRIPTION OF THE DRAWINGS

These and other objects and advantages will become apparent upon reading the detailed description and upon referring to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which:

FIG. 4 is a front perspective view of a bottom connector in accordance with an embodiment;

FIG. 5 is a rear perspective view of the bottom connector shown in FIG. 4;

FIG. 29 is another detailed perspective view of the detonator shown in FIG. 27;

FIG. 30 is another detailed perspective view of the detonator shown in FIG. 27;

DETAILED DESCRIPTION

In the following description and accompanying FIGS., the same numerical references refer to similar elements throughout the FIGS. and text. Furthermore, for the sake of simplicity and clarity, namely so as not to unduly burden the FIGS. with several reference numbers, only certain FIGS. have been provided with reference numbers, and components and features of the embodiments illustrated in other FIGS. can be easily inferred therefrom. The embodiments, geometrical configurations, and/or dimensions shown in the FIGS. are for exemplification purposes only. Various features, aspects and advantages of the embodiments will become more apparent from the following detailed description.

Moreover, although some of the embodiments were primarily designed for well bore perforating, for example, they may also be used in other perforating scenarios or in other fields, as apparent to a person skilled in the art. For this reason, expressions such as "gun system", etc., as used herein should not be taken as to be limiting, and includes all other kinds of materials, objects and/or purposes with which the various embodiments could be used and may be useful. Each example or embodiment are provided by way of explanation, and is not meant as a limitation and does not constitute a definition of all possible embodiments.

In addition, although some of the embodiments are illustrated in the accompanying drawings comprise various components and although the embodiment of the adjustment system as shown consists of certain geometrical configurations as explained and illustrated herein, not all of these components and geometries are essential and thus should not be taken in their restrictive sense, i.e. should not be taken as to limit the scope. It is to be understood, as also apparent to a person skilled in the art, that other suitable components and cooperations thereinbetween, as well as other suitable geometrical configurations may be used for the adjustment systems, and corresponding parts, according to various embodiments, as briefly explained and as can easily be inferred herefrom by a person skilled in the art, without departing from the scope.

Figure 1:
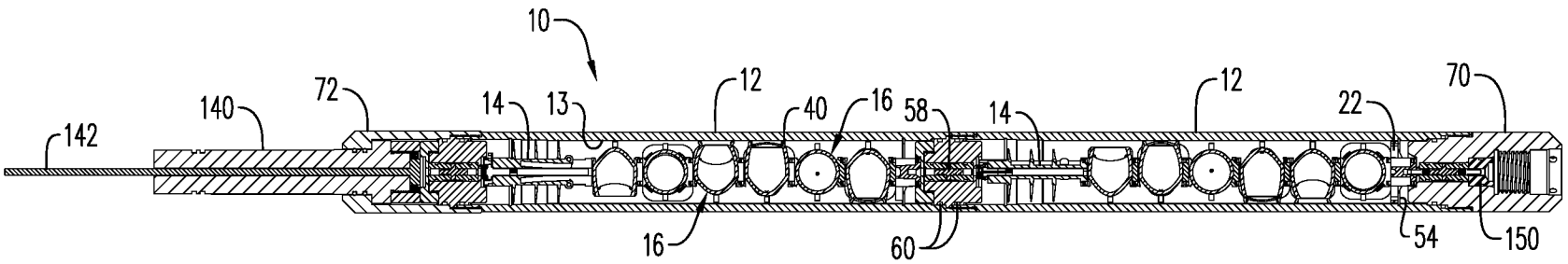
FIG. 1 is a side cut view of a perforation gun system according to an embodiment.
Figure 2:
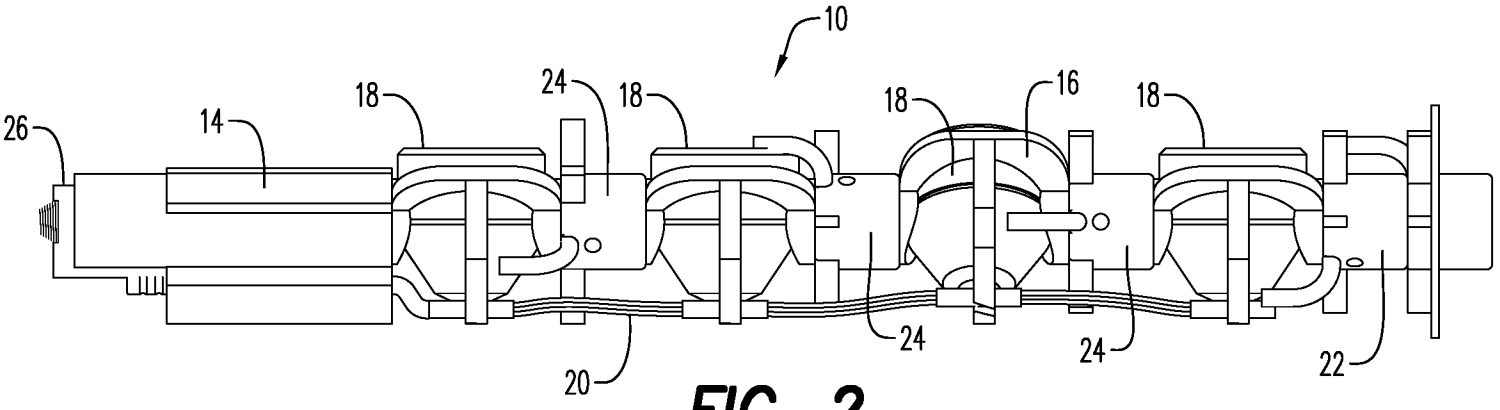
FIG. 2 is a side view of a top connector, bottom connector and stackable charge holders of a perforation gun system in accordance with another embodiment.
Figure 3:
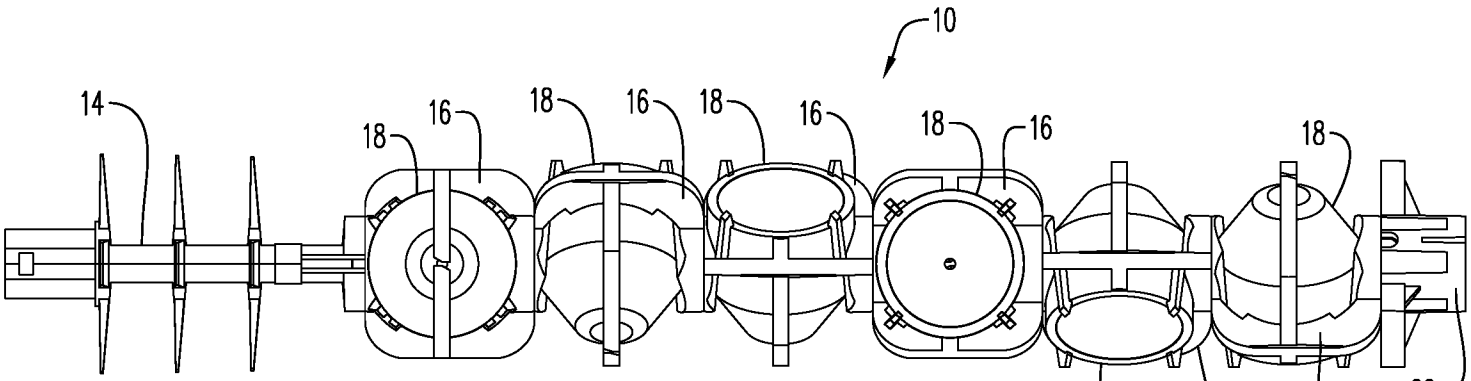
FIG. 3 is a side view of a top connector, bottom connector and stackable charge holders of a perforation gun system in accordance with another embodiment.
Figure 6:
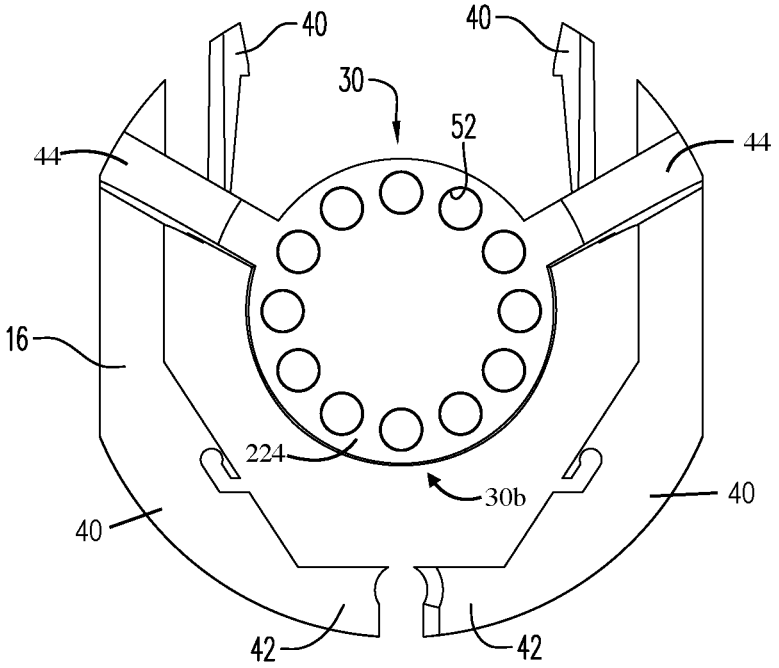
FIG. 6 is a front view of a stackable charge holder in accordance with an embodiment.
Figure 7:
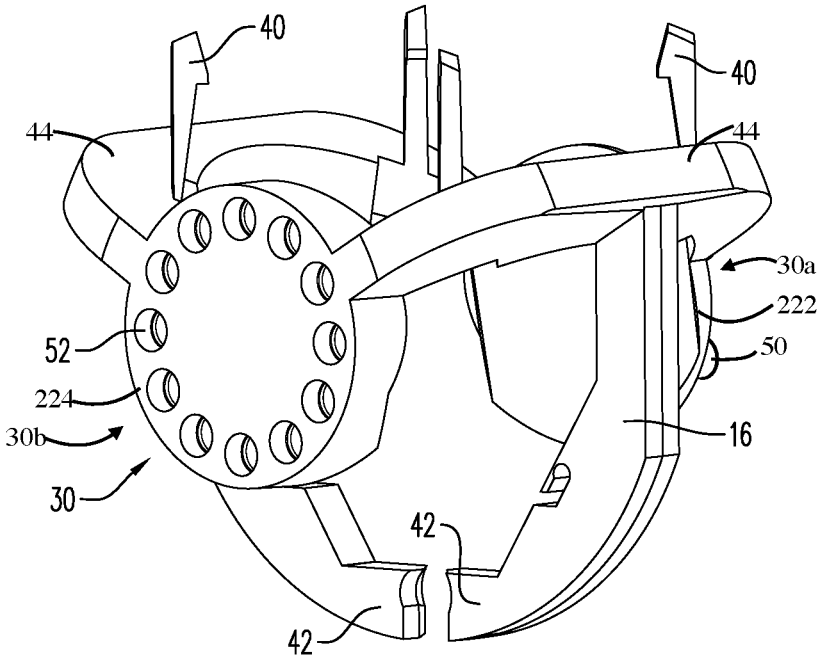
FIG. 7 is a front perspective view of the stackable charge holder shown in FIG. 6.
Figure 8:
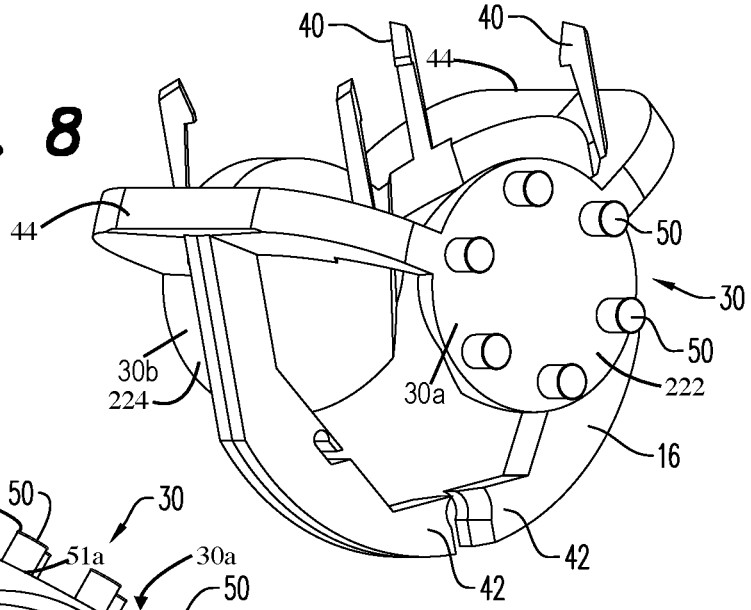
FIG. 8 is a rear perspective view of the stackable charge holder shown in FIG. 6.
Figure 9:
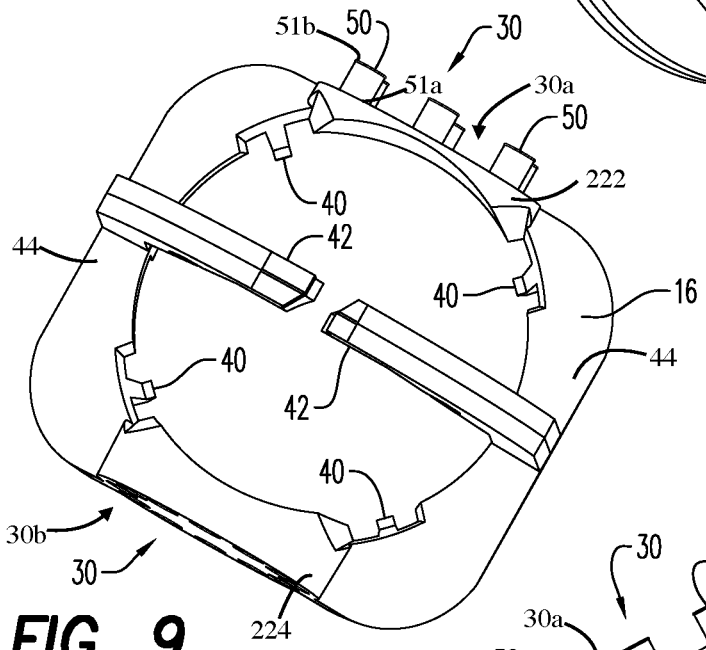
FIG. 9 is a bottom view of the stackable charge holder shown in FIG. 6.
Figure 10:
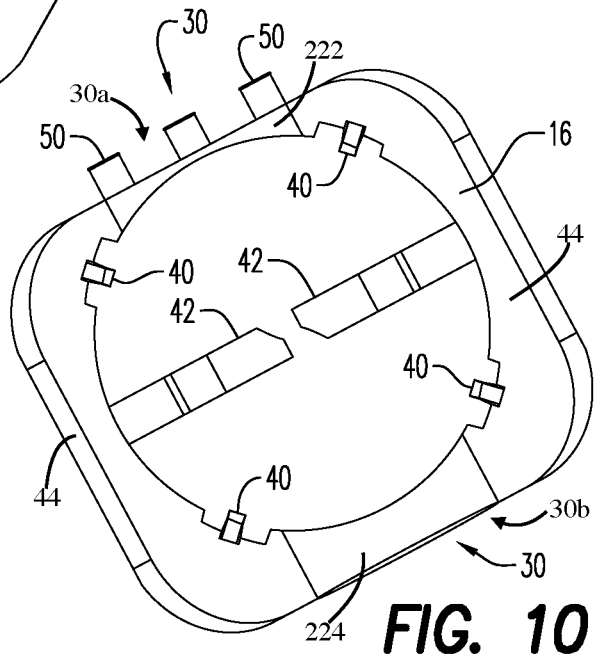
FIG. 10 is a top view of the stackable charge holder shown in FIG. 6.

Referring to FIGS. 1 to 3, an object is to provide a perforation gun system 10 having an outer gun carrier 12. The gun system 10 includes a top connector 14. At least one stackable charge holder 16 is provided for centralizing a single shaped charge 18 within the gun carrier 12. A detonation cord 20 is connected to the top connector 14 and to each stackable charge holder 16.

The gun system 10 includes at least one bottom connector 22 for terminating the detonation cord 20 in the gun system. As better shown in FIG. 2, it is also possible that the bottom connector 22 double as or serve the function of a spacer 24 for spacing a plurality of stackable charge holders 16.

In an embodiment, the gun system also includes a detonator 26 energetically coupled to the detonation cord 20.

As better shown in FIGS. 4 to 18, each of the top connector 14, stackable charge holder 16 and bottom connector 22 includes a rotation coupling 30 for providing a selectable clocking rotation between each of the above-mentioned components. As seen, for instance, in FIGS. 4-5 and 7-9, the rotation coupling 30 includes a first rotation coupling 30*a* and a second rotation coupling 30*b*.

Hence, a user can build multiple configurations of gun systems using various combinations of basic components. A first of these basic components includes a top connector. Another basic component is a single charge holder that centralizes a single shaped charge. The holder is adapted to be stacked and configured into 0, 30, 60, up to 360 degrees or any other combination of these phases for any specified length. Another basic component is a bottom connector that terminates the detonation cord in the gun. The bottom connector may carry as well an electrical connection therethrough. The bottom connector may also double as an imperial measurement stackable spacer to provide any gun shot density up to, for example, 6 shots per foot. Alternately, another bottom connector may be provided or configured to double as a metric measurement stackable spacer to provide any gun shot density up to, for example, 20 shots per meter. Another basic component includes a push-in detonator that does not use wires to make necessary connections. The push-in detonator may uses spring-loaded connectors, thus replacing any required wires and crimping.

Therefore, within the self-centralizing charge holder system, any number of spacers can be used with any number of holders for any specific metric or imperial shot density, phase and length gun system.

In an embodiment, only two pipe wrenches are required for assembly on site of the gun system, as no other tools are required.

In an embodiment, the top connector 14 provides energetic coupling between the detonator and detonating cord.

In an embodiment, each of the top connector 14, stackable charge holder 16 and bottom connector 22 are configured to receive electrical connections therethrough.

In an embodiment, all connections are made by connectors, such as spring-loaded connectors, instead of wires, with the exception of the through wire that goes from the top connector 14 to the bottom connector 22, whose ends are connectors.

In an embodiment, components of the assembly may include molded parts, which may also be manufactured to house the wiring integrally, through, for instance, overmolding, to encase the wiring and all connectors within an injection molded part. For example, the charge holder 16 could be overmolded to include the through wire.

Figure 19:
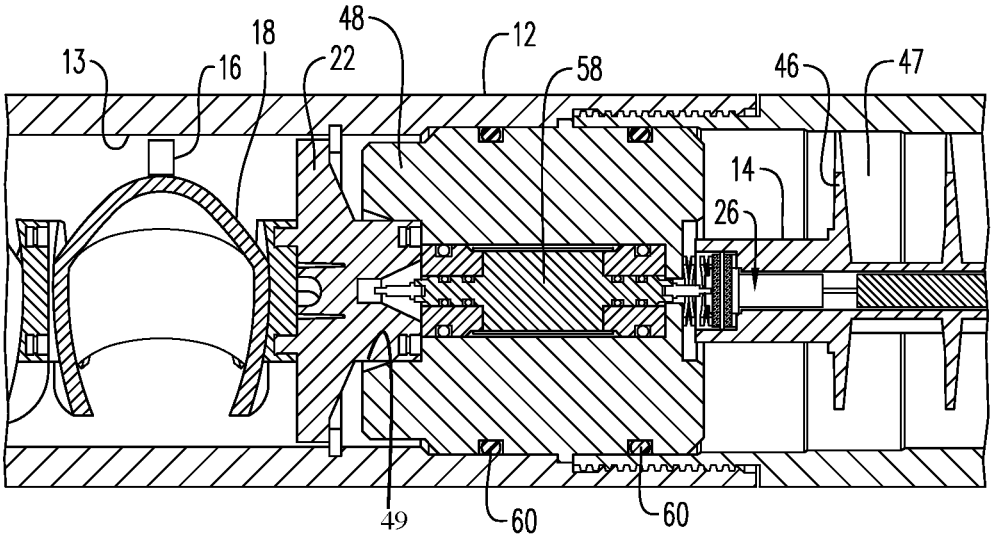
FIG. 19 is an enlarged detailed side cut view of a portion of the perforation gun system including a bulkhead and stackable charge holders shown in FIG. 1.

In an embodiment, and as shown in FIGS. 4 and 5, each bottom connector 22 includes a cylindrical body 220 comprising a first base 222 and a second base 224. The pins 50 outwardly extend from the first base 222, and the sockets 52 at least partially extend into the second base 224. As illustrated in FIGS. 4 and 5, each socket 52 is spaced apart from an adjacent socket and each pin 50 is spaced apart from an adjacent pin. The cylindrical body 220 may include a plurality of alternating v-shaped channels 221 and v-shaped walls 223. The v-shaped channels partially extend from the first base 222 towards the second base 224, and the v-shaped walls 223 extend from the second base 224 to the first base 222. At least one of the pins 50 of the rotation coupling 30 extend from one of the v-shaped walls 223. According to an aspect, when the bottom connector includes the first rotation coupling 30*a* and the second rotation coupling 30*b*, the cylindrical body 220 extends therebetween. The bottom connector 22 includes a plurality of fins/wings 32 radially extending from the body 220. The wings 32 are configured for axially locking each bottom connector against a snap ring 54, or an equivalent retainment mechanism to keep the charge holder 16 from sliding out of the bottom of carrier 12 as it is handled, (shown on FIG. 1). According to an aspect, and as illustrated in FIG. 19, the bottom connector 22 may be recessed into a recess 49 formed in the tandem seal adapter 48. The bottom connector 22 from a first gun assembly can accommodate or house an electrical connection through a bulkhead assembly 58 to the top connector 14 of a second or subsequent gun assembly, as seen for instance in FIG. 19. The top and bottom connector, as well as the spacer, in an embodiment, are made of 15% glass fiber reinforced, injection molding PA6 grade material, commercially available from BASF under its ULTRAMID® brand, and can provide a positive snap connection for any configuration or reconfiguration. As better shown in FIG. 5, a terminating means structure 34 is provided to facilitate terminating of the detonation cord. The structure 34 may be formed in the first base 222. The snap ring 54 is preinstalled on the bottom of the carrier 12. The assembly can thus shoulder up to the snap ring 54 via the bottom connector fins 32.

In an embodiment and as shown in FIGS. 6 to 10, each stackable charge holder 16 includes a charge receiving structure for receiving a single shaped charge, and a plurality of projections 40 extending from the charge receiving structure. The projections 40 may rest against an inner surface 13 or diameter of the gun carrier 12 (as shown in FIG. 1) and thereby centralizing the shaped charge therewithin. The charge receiving structure may include a pair of arms 44, and each projection 40 may extend from at least one of the arms 44. A pair 42 of the plurality of projections 40 may also be configured for capturing the detonation cord (not shown) traversing each stackable charge holder 16. The pair 42 of the plurality of projections are also used for centralizing the shaped charge within an inner surface of the gun carrier. According to an aspect, the stackable charge holder 15 includes a first base 222 and a second base 224 spaced apart from the first base 222. The arms 44 extend between the first and second bases 222, 224. According to an aspect, the pins 50 outwardly extend from the first base 222, and the sockets 52 at least partially extend into the second base 224. Each pin is spaced apart from an adjacent pin, and each socket 52 is spaced apart from an adjacent socket.

Figure 11:
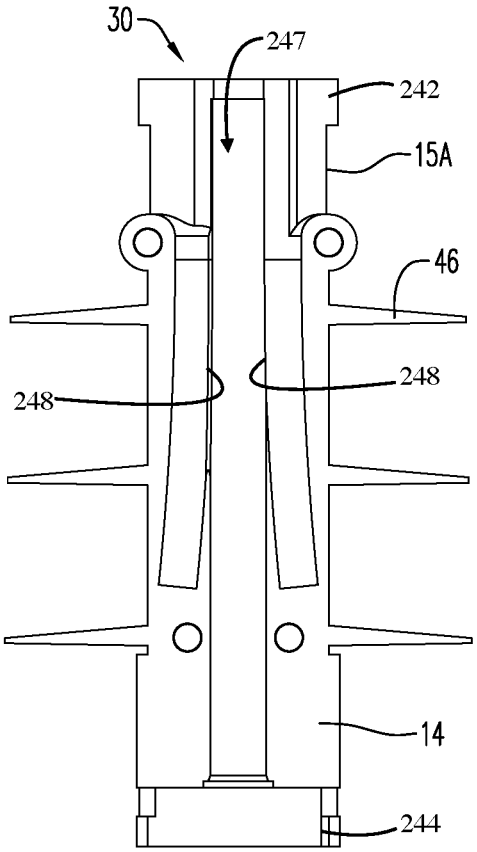
FIG. 11 is a bottom view of a half-portion of a top connector in accordance with an embodiment.
Figure 12:
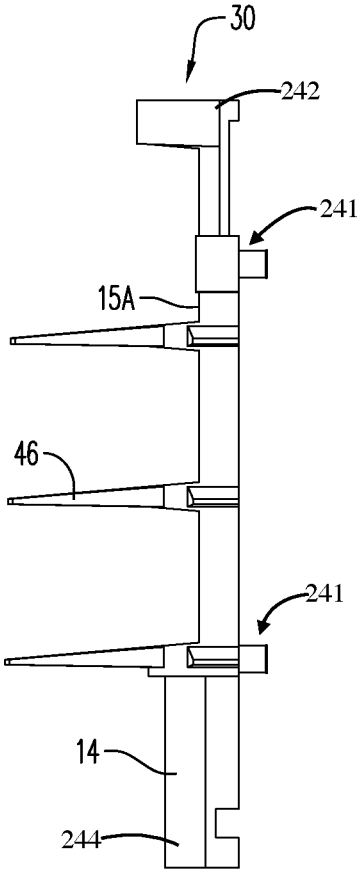
FIG. 12 is a side view of the half-portion of the top connector shown in FIG. 11.
Figure 13:
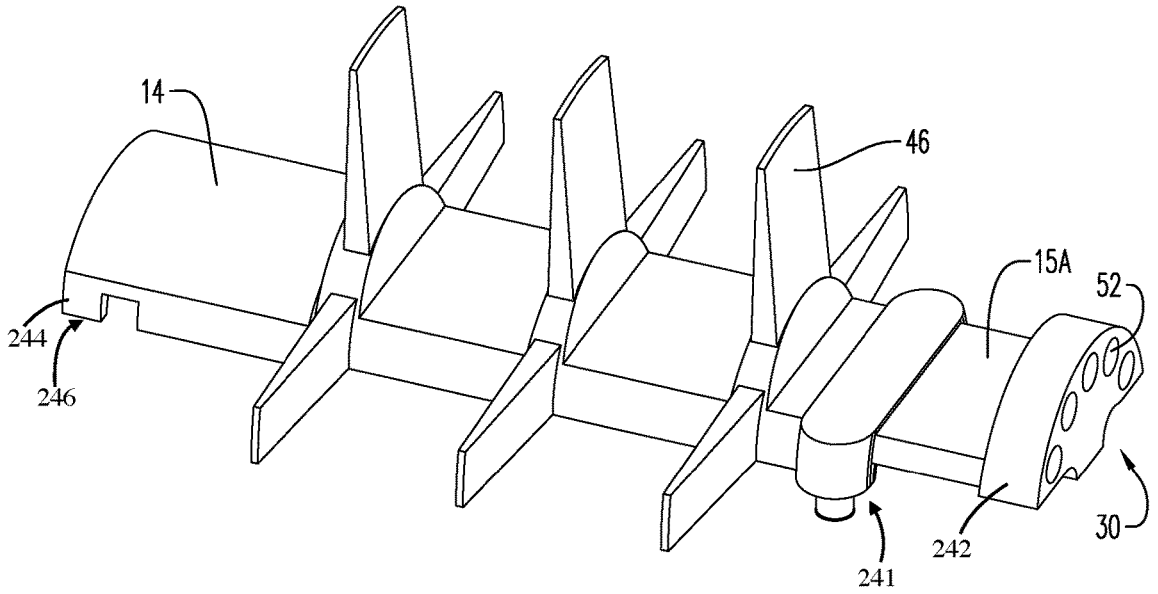
FIG. 13 is a top perspective view of the half-portion of the top connector shown in FIG. 11.
Figure 14:
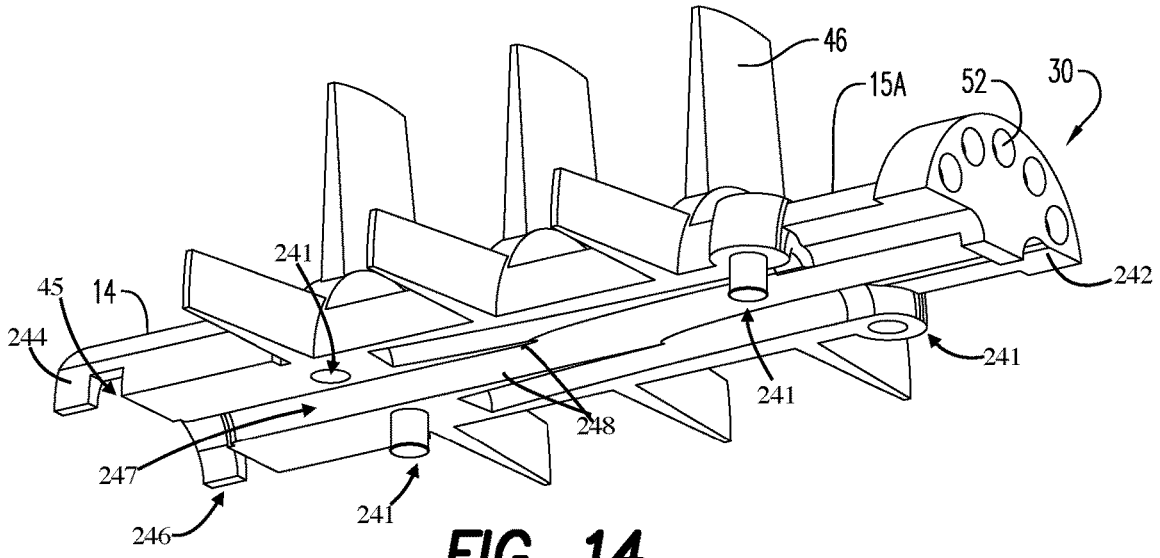
FIG. 14 is a bottom perspective view of the half-portion of the top connector shown in FIG. 11.
Figure 15:
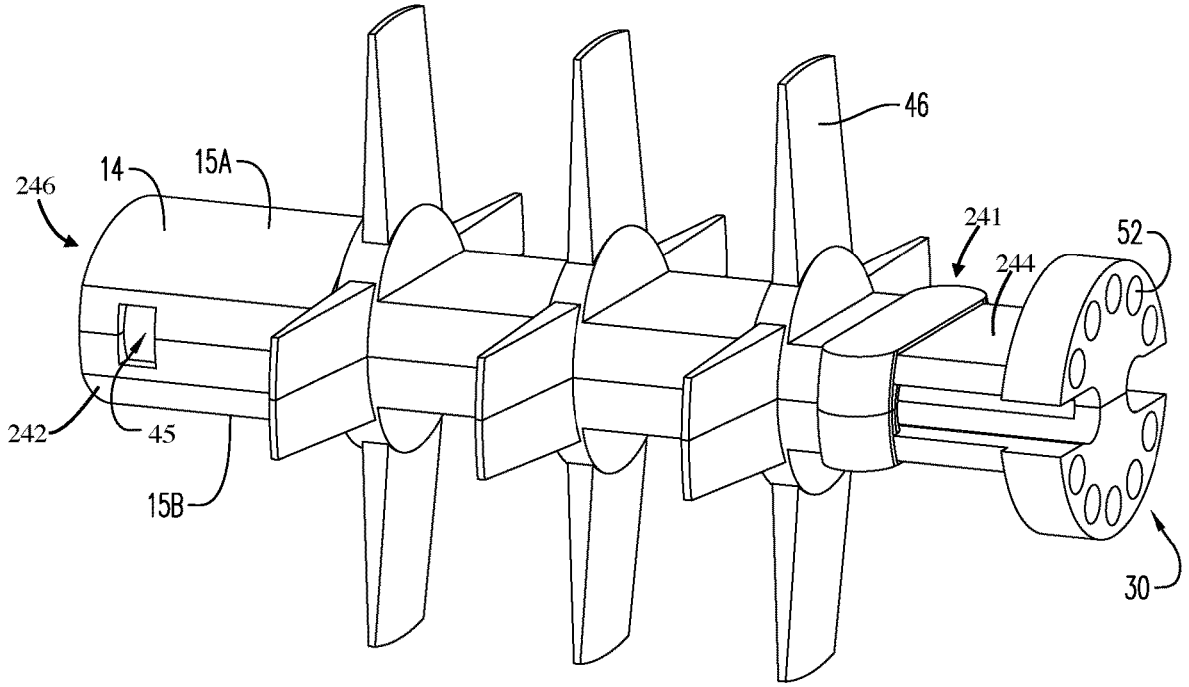
FIG. 15 is a perspective view of a top connector in accordance with an embodiment.
Figure 16:
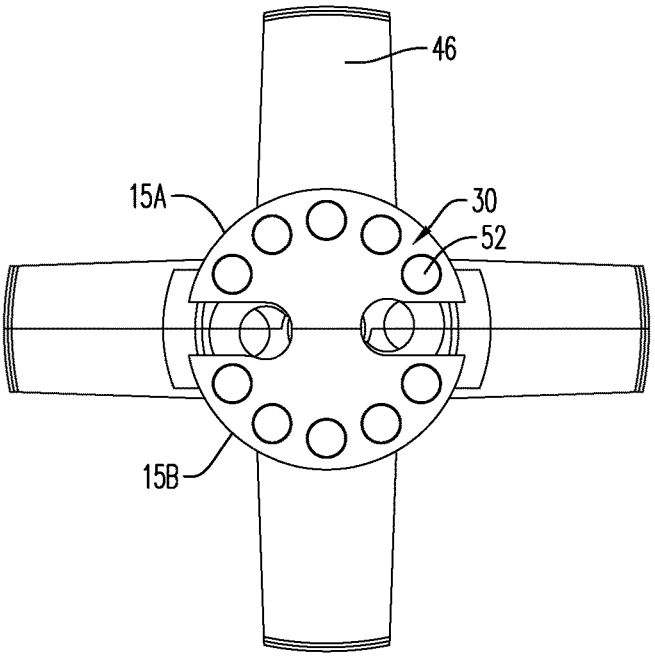
FIG. 16 is a front end view of the top connector shown in FIG. 15.
Figure 17:
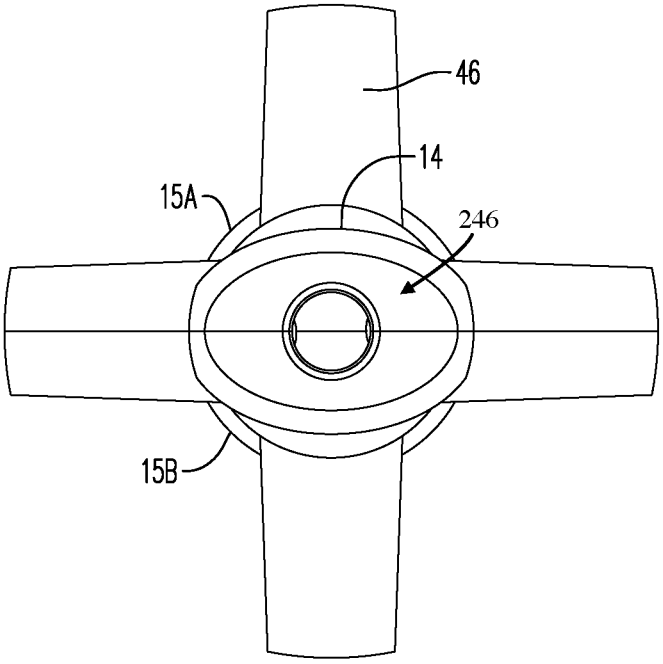
FIG. 17 is a rear end view of the top connector shown in FIG. 15.
Figure 18:
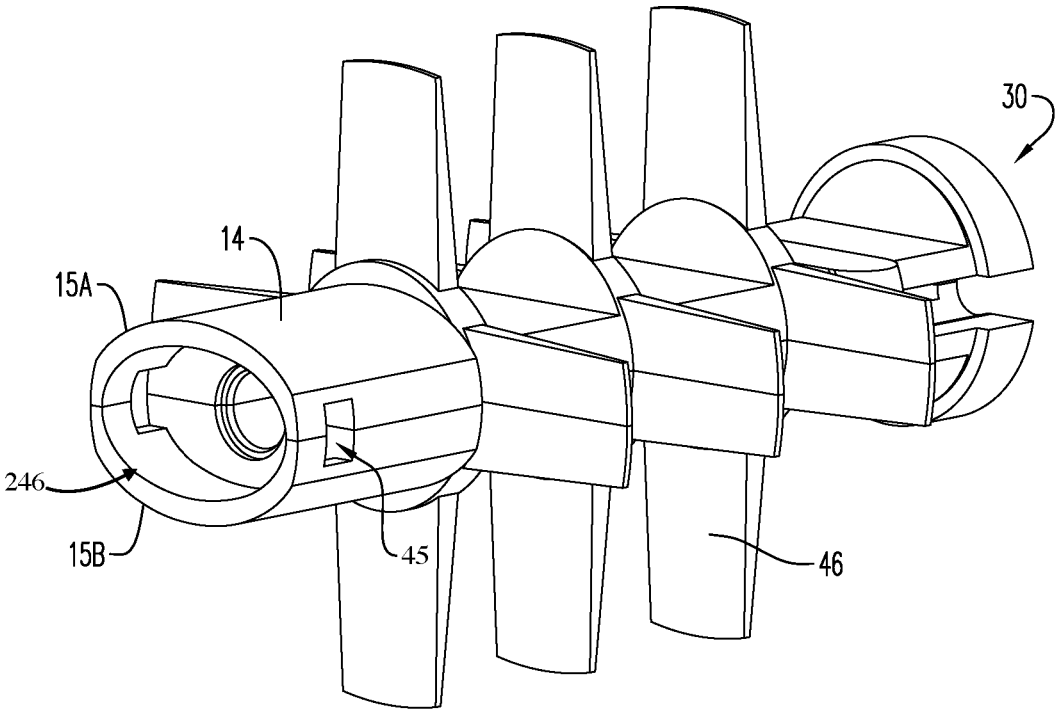
FIG. 18 is a rear perspective view of the top connector shown in FIG. 15.

In an embodiment, as shown in FIGS. 11 to 18, the top connector 14 includes a first end 242, a second end 244, and a coupler 246 formed at the first end 242. The top connector 14 may be configured for providing energetic coupling between the detonator 26 and a detonation cord. According to an aspect and as illustrated in FIGS. 11 and 14, an elongated opening 247 extends from the second end 244, adjacent the coupler 246, towards the first end 242. The elongated opening 247 is flanked by side walls 248 that provide the energetic coupling between the detonator 26 and the detonation cord 20. A rotation coupling 30 is formed at the second end 244. The rotation coupling includes at least one of a plurality of pins 50 and a plurality of sockets 52. According to an aspect, the top connector 14 includes at least one directional locking fin 46. Although the use of directional locking fins is described, other methods of directional locking may be used, in order to eliminate a top snap ring that would otherwise be used to lock the assembly. As better shown in FIG. 19, the locking fins 46 are engageable with corresponding complementarily-shaped structures 47 housed within the carrier 12, upon a rotation of the top connector 14, to lock the position of the top connector along the length of the carrier 12.

In an embodiment, as better shown in FIG. 19, the bottom connector 22 on one end and the top connector 14 on the other end abuts/connects to the bulkhead assembly 58. The tandem seal adapter 48 is configured to seal the inner components within the carrier 12 from the outside environment, using sealing means 60 (shown herein as o-rings). Thus, the tandem seal adapter 48 seals the gun assemblies from each other along with the bulkhead 58, and transmits a ground wire to the carrier 12. Hence, the top connector 14 and bulkhead 58 accommodate electrical and ballistic transfer to the charges of the next gun assembly for as many gun assembly units as required, each gun assembly unit having all the components of a gun assembly.

In an embodiment, the tandem seal adapter 48 is a two-part tandem seal adapter (not shown) that fully contains the bulkhead assembly 58 (comprised of multiple small parts as shown, for instance, in FIG. 19) and that is reversible such that it has no direction of installation.

In an embodiment and as better shown in FIGS. 27-31 and 35A, the detonator assembly 26 includes a detonator head 100, a detonator body 102 and a plurality of detonator wires 104, including a through wire 106, a signal-in wire 108 and a ground wire 110. The through wire 106 traverses from the top to the bottom of the perforating gun system 10, making a connection at each charge holder 16. The detonator head 100 further includes a through wire connector element 112 connected to the through wire 106 (not shown), a ground contact element 114 for connecting the ground wire 110 to the tandem seal adapter (also not shown), through ground springs 116, and a bulkhead connector element 118 for connecting the signal-in wire 108 to the bulkhead assembly 58 (also not shown). Different insulating elements 120A, 120B are also provided in the detonator head 100 for the purpose of insulating the detonator head 100 and detonator wires 104 from surrounding components. As better shown in FIG. 31, a crimp sleeve 122 can be provided to cover the detonator head 100 and body 102, thus resulting in a more robust assembly. The above configuration allows the detonator to be installed with minimal tooling and wire connections.

Figure 32:
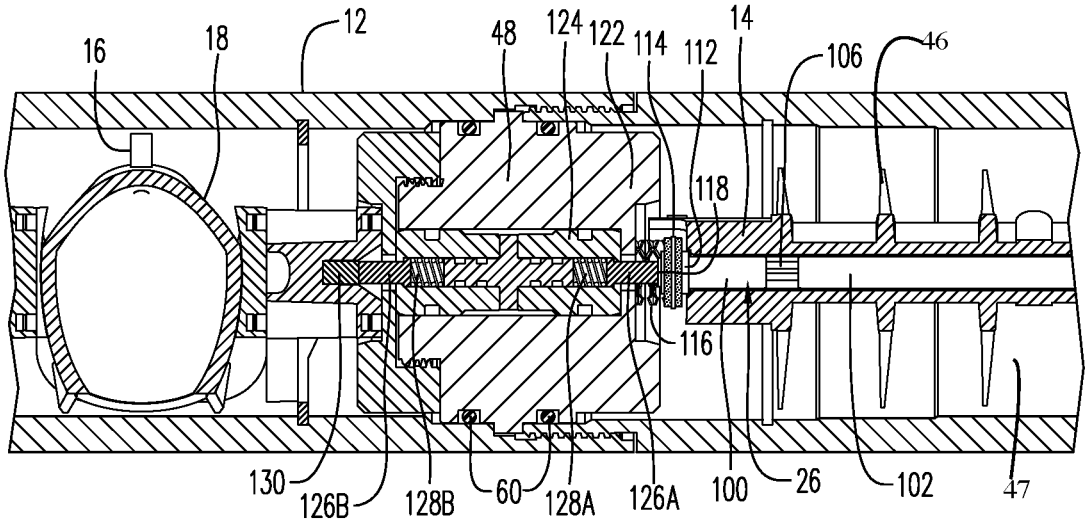
FIG. 32 is a detailed side view of a tandem seal adapter and detonator in accordance with another embodiment.
Figure 33:
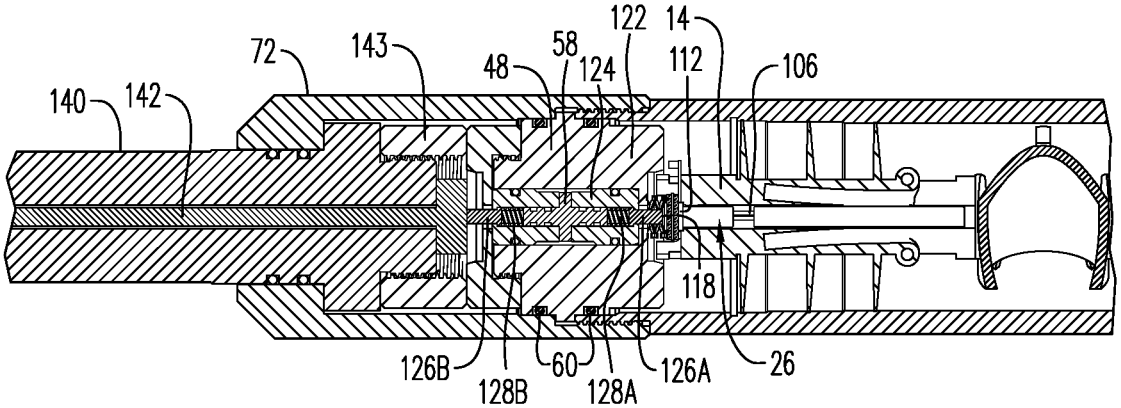
FIG. 33 is a side cut view of a portion of a perforation gun system illustrating the configuration of the top sub in accordance with another embodiment.
Figure 35A:
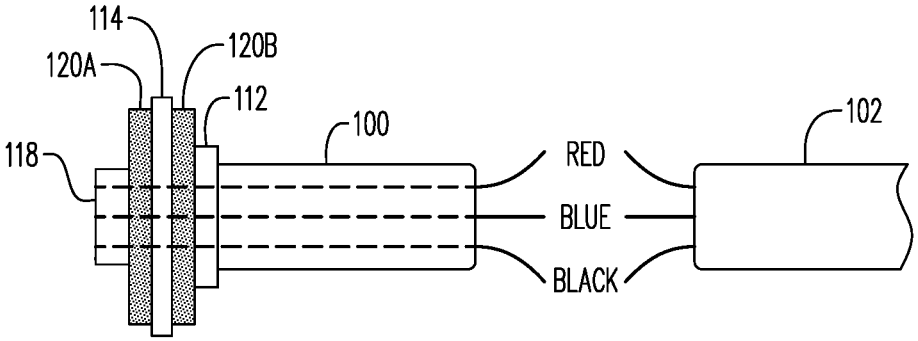
FIGS. 35A and 35B are electrical schematic views of a detonator and of wiring within a perforated gun system in accordance with another embodiment.
Figure 35B:
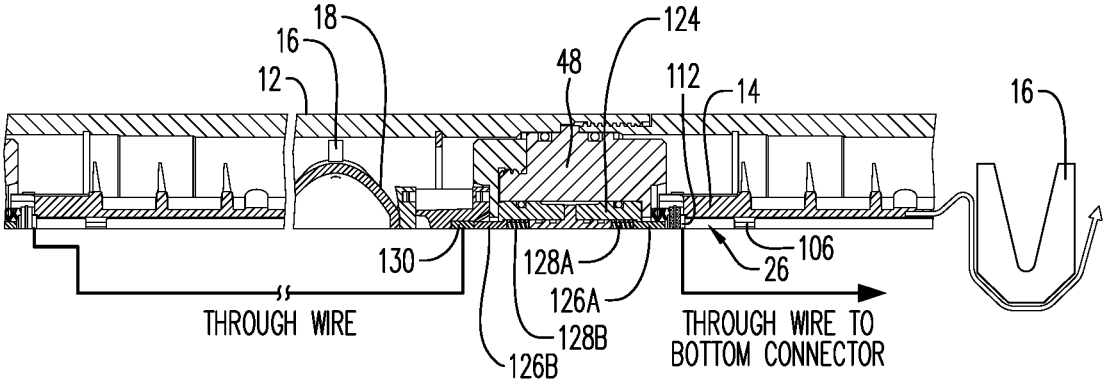

In an embodiment as shown in FIGS. 32, 33 and 35B illustrate a connection of the above-described detonator assembly 26 to the tandem seal adapter 48 and a pressure bulkhead 124. The bulkhead 124 includes spring connector end interfaces comprising contact pins 126A, 126B, linked to coil springs 128A, 128B. This dual spring pin connector assembly including the bulkhead 124 and coil springs 128A, 128B is positioned within the tandem seal adapter 48 extending from a conductor slug 130 to the bulkhead connector element. The dual spring pin connector assembly is connected to the through wire 106 of the detonator assembly 26.

In an embodiment and as better shown in FIGS. 11 to 18, the top connector 14 may have a split design to simplify manufacturing and aid in assembly. By "split design" what is meant is that the top connector 14 can be formed of two halves—a top half 15A and a bottom half 15B. A plurality of securing mechanisms 241 may be provided to couple the top half 15A to the bottom half 15B. As better shown in FIG. 15 or 18, the top connector 14 may also include a blind hole 45 to contain or house the detonation cord, thus eliminating the need for crimping the detonation cord during assembly.

In an embodiment and as shown for example in FIGS. 4 to 18, the rotation coupling 30 may either include a plurality of pins 50 (FIG. 5) symmetrically arranged about a central axis of the rotation coupling 30, or a plurality of sockets 52 (FIG. 4) symmetrically arranged about the central axis of the rotation coupling 30 and configured to engage the plurality of pins 50 of an adjacent rotation coupling 30. The pins each include a first end 51*a*, and a second end 51*b* opposite the first end 51*a*. According to an aspect, the second end 51*b* is wider than the first end 51*a*.

In another embodiment, the rotation coupling 30 may either include a polygon-shaped protrusion, or a polygon-shaped recess configured to engage the polygon-shaped protrusion of an adjacent rotation coupling. The polygon can be 12-sided for example for 30 degree increments.

In another embodiment, the top and bottom subs work with off the shelf running/setting tools as would be understood by one of ordinary skill in the art.

In one embodiment and as shown in FIG. 33, the top sub 72 facilitates use of an off the shelf quick change assembly 140 to enable electrical signals from the surface, as well as to adapt perforating gun system to mechanically run with conventional downhole equipment. The quick change assembly 140 may include a threaded adapter 143 to set an offset distance between an electrical connector 142 and the contact pin 126B extending from the bulkhead assembly 58.

Figure 34:
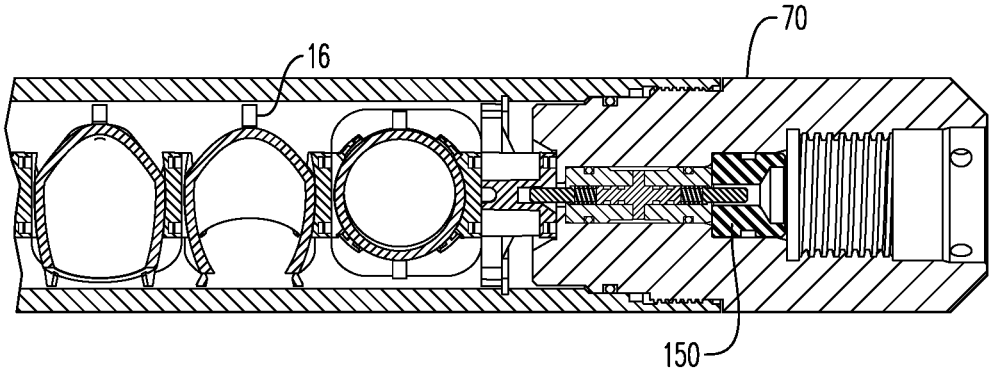
FIG. 34 is a side cut view of a portion of a perforation gun system illustrating the configuration of the bottom sub in accordance with another embodiment.

In one embodiment and as shown in FIG. 34, the bottom sub 70 may be configured as a sealing plug shoot adapter (SPSA) to be used specifically with this embodiment. The SPSA may receive an off the shelf quick change assembly 140 (not shown) and insulator 150 that communicates with a firing head threaded below it (not shown). A setting tool (not shown) may run on the bottom side of the perforating gun.

In an embodiment, final assembly of the tool string requires only two pipe wrenches. No tools are required to install the detonator or any electrical connections.

An object is to also provide a perforation gun system kit having the basic component parts described above and capable of being assembled within an outer gun carrier.

Figure 21:
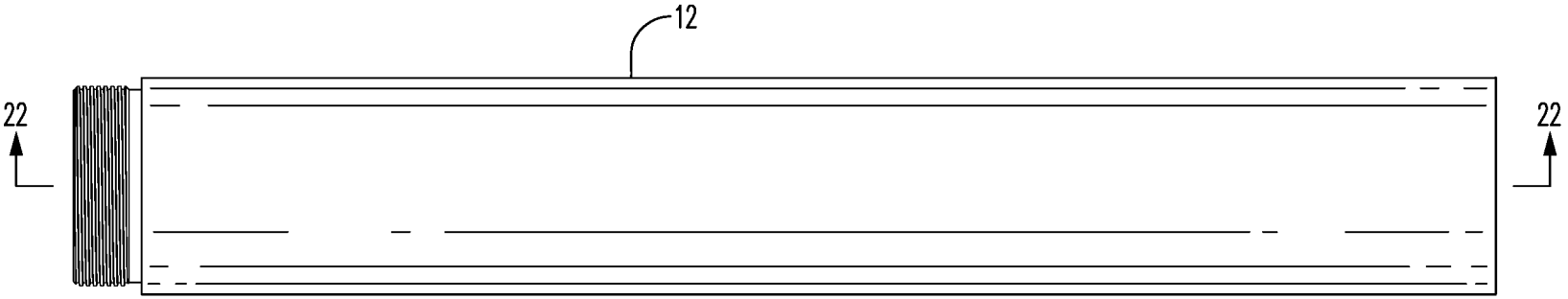
FIG. 21 is a side view of a gun carrier of a gun system in accordance with an embodiment.
Figure 22:
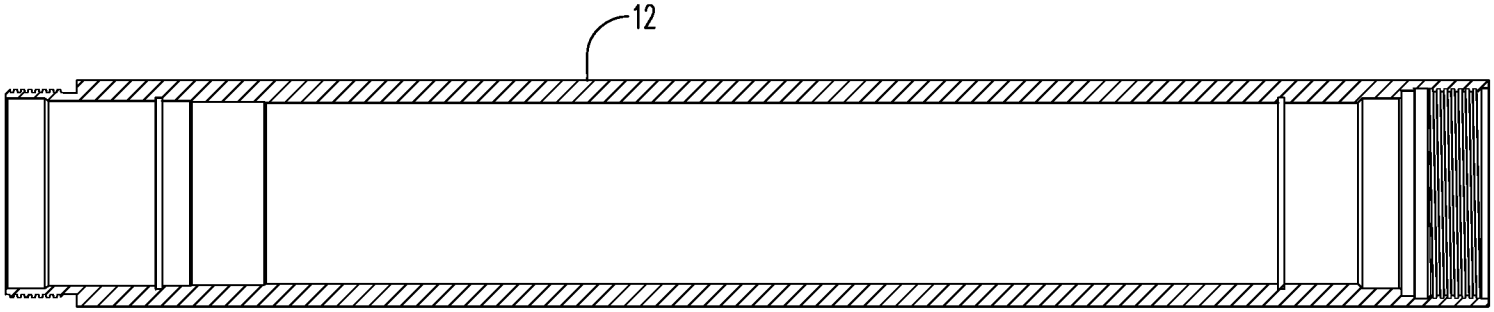
FIG. 22 is a side cut view of the gun carrier shown in FIG. 21.

In an embodiment, a method for assembling a perforation gun system is provided, to which a certain number of optional steps may be provided. The steps for assembling the gun system for transport include the steps of:

providing a perforation gun system kit having component parts capable of being assembled within an outer gun carrier (element 12 in FIGS. 1, 21 and 22), the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system and adapted for doubling as a spacer for spacing a plurality of stackable charge holders; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector;

assembling a plurality of the stackable charge holders in a predetermined phase to form a first gun assembly;

running the detonation cord into a bottommost bottom connector;

assembling the bottommost bottom connector onto the assembled plurality of stackable charge holders;

running a through wire between the bottommost bottom connector and the top connector, so that the through wire goes from the top connector to the bottom connector;

clicking the detonation cord into recesses formed in capturing projections, the capturing projections being provided in each of the charge holders;

running the detonation cord into the top connector;

cutting the detonator cord, if the detonator cord is not precut a predetermined length; and installing charges into each of the charge holders.

In an embodiment, the method further includes, prior to transport, the steps of: pushing assembled components together to engage all pin connections therebetween; and carrying out a continuity test to ensure complete connectivity of the detonating chord.

Figure 20:
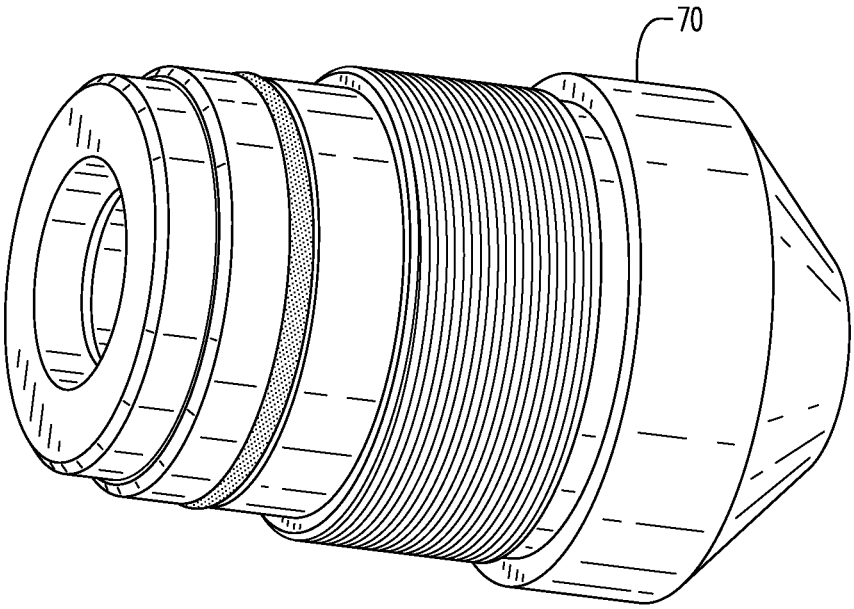
FIG. 20 is a perspective view of a bottom sub of a gun system in accordance with an embodiment.
Figure 23:
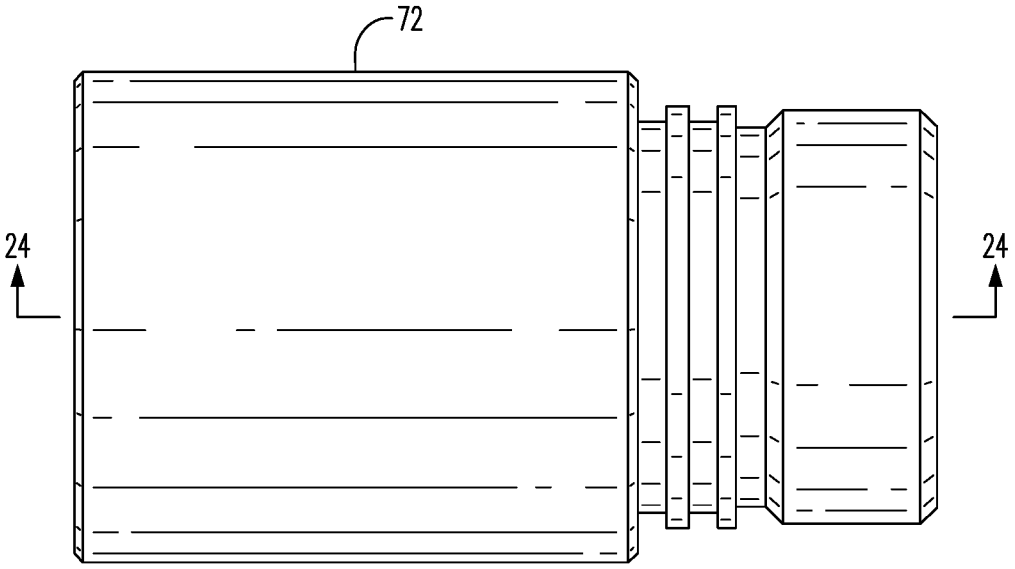
FIG. 23 is a side view of a top sub of a gun system in accordance with an embodiment.
Figure 24:
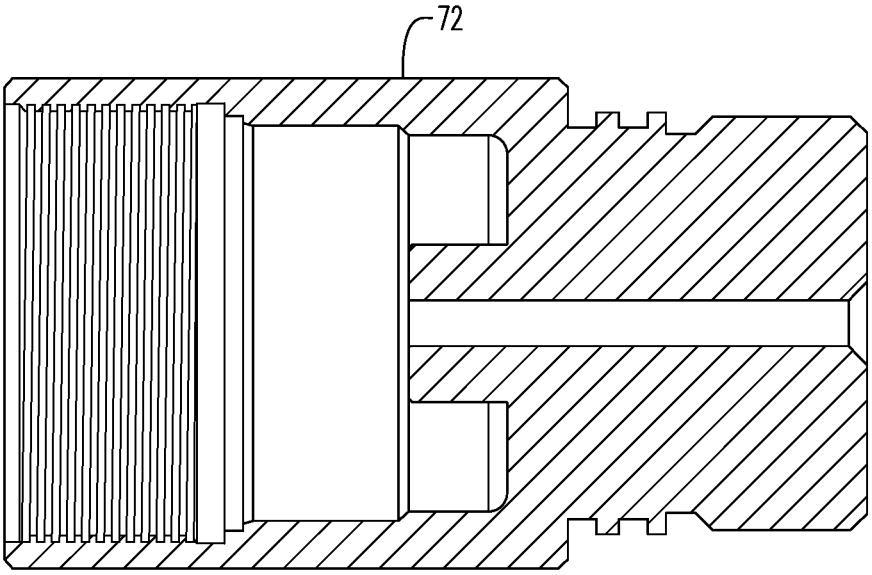
FIG. 24 is a side cut view of the top sub shown in FIG. 23.
Figure 25:
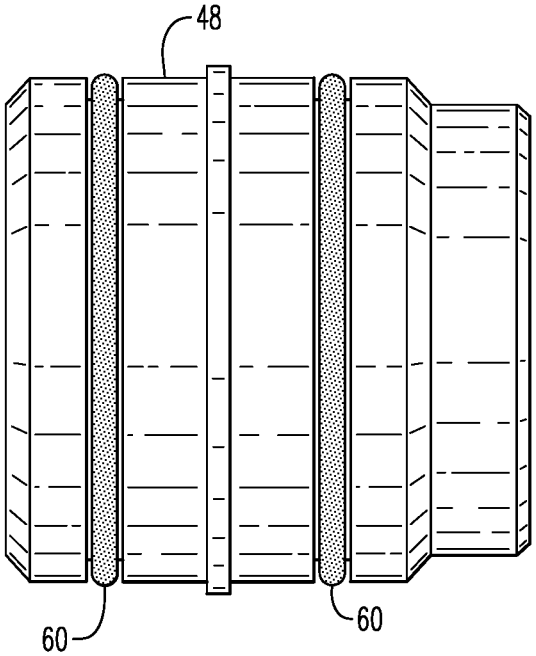
FIG. 25 is a side view of a tandem seal adapter of a gun system in accordance with an embodiment.
Figure 26:
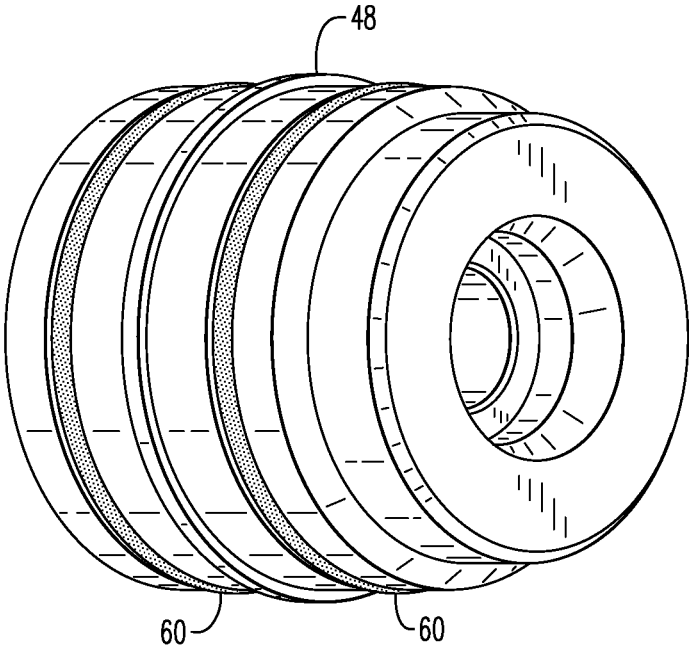
FIG. 26 is a perspective view of the tandem seal adapter shown in FIG. 25.
Figure 27:
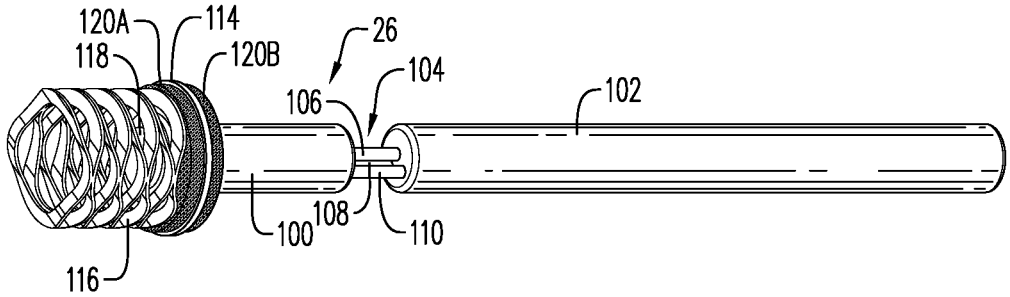
FIG. 27 is a perspective view of a detonator in accordance with an embodiment.
Figure 28:
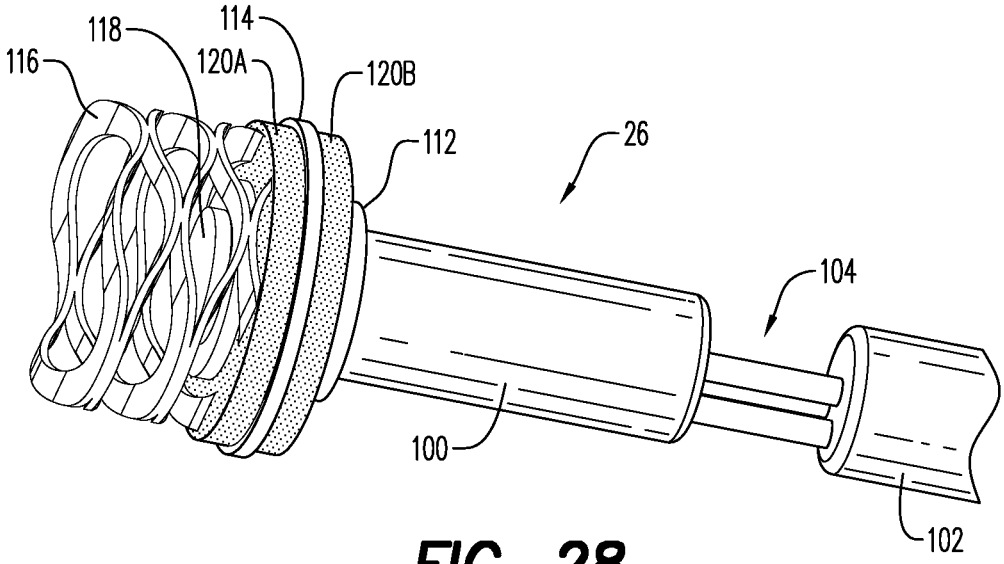
FIG. 28 is a detailed perspective view of the detonator shown in FIG. 27.
Figure 31:
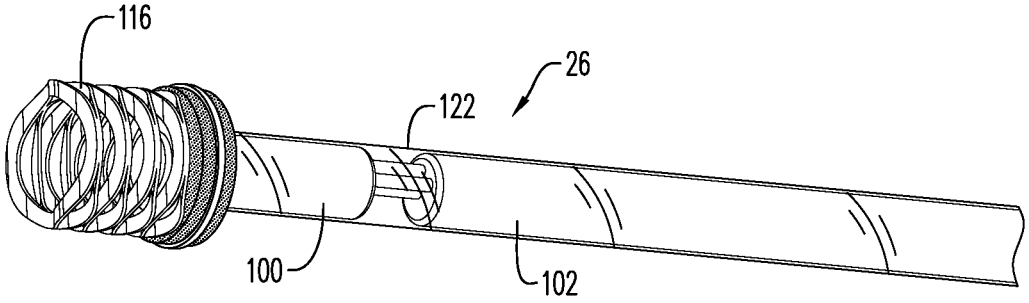
FIG. 31 is another detailed perspective view of the detonator shown in FIG. 27, with a crimp sleeve.

In an embodiment, on location, to complete the assembly, the method further comprises the steps of threading on the previously assembled components a bottom sub (element 70 on FIGS. 1 and 20);

installing and connecting the detonator;

pushing in a tandem seal adapter with o-rings onto the first gun assembly;

pushing in a bulkhead (element 58 in FIG. 19) onto the tandem seal adapter, if the bulkhead and the tandem seal adapter are not pre-assembled;

threading a subsequent gun assembly onto the first gun assembly or threading a top sub (element 72 in FIGS. 1, 23 and 24) onto a topmost assembled gun assembly, for connection to a quick change assembly.

Of course, the scope of the perforation gun system, various perforation gun components, the perforation gun system kit, and the method for assembling a perforation gun system should not be limited by the various embodiments set forth herein, but should be given the broadest interpretation consistent with the description as a whole. The components and methods described and illustrated are not limited to the specific embodiments described herein, but rather, features illustrated or described as part of one embodiment can be used on or in conjunction with other embodiments to yield yet a further embodiment. Further, steps described in the method may be utilized independently and separately from other steps described herein. Numerous modifications and variations could be made to the above-described embodiments without departing from the scope of the FIGS. and claims, as apparent to a person skilled in the art.

In this specification and the claims that follow, reference will be made to a number of terms that have the following meanings. The singular forms "a," "an" and "the" include plural referents unless the context clearly dictates otherwise. Further, reference to "top," "bottom," "front," "rear," and the like are made merely to differentiate parts and are not necessarily determinative of direction. Similarly, terms such as "first," "second," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples to disclose the perforation gun system, various perforation gun components, the perforation gun system kit, and the method for assembling a perforation gun system, including the best mode, and also to enable any person of ordinary skill in the art to practice same, including making and using any devices or systems and performing any incorporated methods. The patentable scope of the perforation gun system, various perforation gun components, the perforation gun system kit, and the method for assembling a perforation gun system is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A system of perforation guns electrically linked to one another, comprising:

two or more perforation guns each including:

an outer gun carrier;

a charge holder configured to receive a shaped charge and housed within the outer gun carrier;

a top connector provided at a first end of the charge holder and housed within the outer gun carrier;

and a bottom connector provided at a second end of the charge holder opposite the first end and housed within the outer gun carrier;

a tandem seal adapter (TSA) positioned between the top connector of a first perforation gun of the two or more perforation guns and the bottom connector of a second perforation gun of the two or more perforation guns;

wherein the TSA comprises:

a TSA body and a first seal element provided on an outer surface of the TSA body;

a bore extending through the TSA body; and a bulkhead provided within the bore and configured to provide electrical connectivity through the bore, the bulkhead comprising:

an outer body provided within the bore and contacting the TSA body, wherein the outer body is non-conductive; and a first electrical contact extending from a first end of the outer body and in contact with the outer body.

2. The system of perforation guns of claim 1, wherein at least one of the two or more perforation guns includes an electrical connection extending from the top connector to the bottom connector, wherein the electrical connection is electrically connected to a conductor on the bottom connector of the first perforation gun.

3. The system of perforation guns of claim 2, wherein the electrical connection is a through wire.

4. The system of perforation guns of claim 1, further comprising a detonator assembly, wherein the top connector is disposed radially about at least a portion of the detonator assembly.

5. The system of perforation guns of claim 4, wherein the detonator assembly includes a ground contact element.

6. The system of perforation guns of claim 1, wherein the first electrical contact is biased by a spring.

7. The system of perforation guns of claim 1, further comprising a sealing contact between the bulkhead and the tandem seal adapter.

8. A system of perforation guns electrically linked to one another without wires between the guns, the system comprising:

a first perforation gun comprising:

a first gun carrier;

a first charge holder configured to receive a first shaped charge and positioned within the first gun carrier;

a first top connector provided at a first end of the first charge holder and positioned within the first gun carrier; and a first bottom connector provided at a second end of the first charge holder opposite the first end and positioned within the first gun carrier;

a second perforation gun comprising:

a second gun carrier;

a second charge holder configured to receive a second shaped charge and positioned within the second gun carrier;

a second top connector provided at a first end of the second charge holder and positioned within the second gun carrier;

and a second bottom connector provided at a second end of the second charge holder opposite the second end and positioned within the second gun carrier;

a tandem seal adapter (TSA) positioned between the second top connector and the first bottom connector;

wherein the TSA comprises:

a TSA body and a first seal element provided on an outer surface of the TSA body;

a bore extending through the TSA body; and a bulkhead provided within the bore and configured to provide electrical connectivity through the bore, the bulkhead comprising:

an outer body provided within the bore and contacting the TSA body, wherein the outer body is non-conductive; and a first electrical contact extending from a first end of the outer body and in contact with the outer body.

9. The system of perforation guns of claim 8, further comprising a sealing contact between the bulkhead and the tandem seal adapter.

10. The system of perforation guns of claim 8, wherein the first perforation gun further comprises a first detonator assembly, the first detonator assembly including a ground connector element.

11. The system of perforation guns of claim 8, wherein the first electrical contact is in electrical contact with a bulkhead connector element of a second detonator assembly, wherein the second perforation gun comprises the second detonator assembly; and the bulkhead further comprises a second electrical contact extending from a second end of the outer body and in electrical communication with the first electrical contact, the second electrical contact being in electrical contact with a conductor positioned in the first bottom connector.

12. The system of perforation guns of claim 11, wherein the second perforation gun further comprises an electrical connection extending from the second top connector to the second bottom connector, wherein the electrical connection is electrically connected to each of a wireless through wire connector portion of the second detonator assembly and a conductor positioned in the second bottom connector.

13. The system of perforation guns of claim 8, wherein the first perforation gun is positioned upstream of the tandem seal adapter, and the second perforation gun is positioned downstream of the tandem seal adapter.

14. An electrical connection assembly for electrically linking two perforation guns without wires between the two perforation guns, the assembly comprising:

a first gun carrier of a first perforation gun of the two perforation guns, the first gun carrier housing a charge holder configured to receive a shaped charge;

a bottom connector positioned within the first gun carrier at an end of the charge holder, the bottom connector including a conductor;

a detonator assembly positioned within a gun carrier of a second perforation gun of the two perforation guns; and a tandem seal adapter (TSA) positioned between the bottom connector of the first perforation gun and the detonator assembly of the second perforation gun;

wherein the TSA comprises:

a TSA body and a first seal element provided on an outer surface of the TSA body;

a bore extending through the TSA body; and a bulkhead provided within the bore and configured to provide electrical connectivity through the bore, the bulkhead comprising:

an outer body provided within the bore and contacting the TSA body, wherein the outer body is non-conductive; and a first electrical contact extending from a first end of the outer body and in contact with the outer body; and the TSA and the bulkhead together provide a two-way pressure seal between the first perforation gun and the second perforation gun, the two-way pressure seal being operative in each of a direction from the first perforation gun to the second perforation gun and a direction from the second perforation gun to the first perforation gun.

15. The electrical connection assembly of claim 14, wherein a top connector of the second perforation gun is disposed radially about at least a portion of the detonator assembly.

16. The electrical connection assembly of claim 14, further comprising:

a first sealing contact between the bulkhead and the tandem seal adapter; and a second sealing contact between the bulkhead and the tandem seal adapter, the second sealing contact spaced apart from the first sealing contact, wherein the first sealing contact is positioned between the first perforation gun and the second sealing contact, and the second sealing contact is positioned between the second perforation gun and the first sealing contact.

17. The electrical connection assembly of claim 14, wherein: the first electrical contact is in electrical contact with the bulkhead connector element of the detonator assembly;

the bulkhead further comprises a second electrical contact extending from a second end of the outer body and in electrical communication with the first electrical contact, the second electrical contact being in electrical contact with the conductor of the bottom connector.

18. The electrical connection assembly of claim 14, wherein the detonator assembly includes a ground connector element.

19. The electrical connection assembly of claim 14, further comprising a sealing contact between the bulkhead and the tandem seal adapter.

* * * * *